US007963686B2

(12) United States Patent
Hu

(10) Patent No.: US 7,963,686 B2
(45) Date of Patent: Jun. 21, 2011

(54) THERMAL DISPERSING STRUCTURE FOR LED OR SMD LED LIGHTS

(76) Inventor: Wen-Sung Hu, Rende Township, Tainan County (TW)

( * ) Notice: Subject to any disclaimer, the term of this patent is extended or adjusted under 35 U.S.C. 154(b) by 126 days.

(21) Appl. No.: 12/503,270

(22) Filed: Jul. 15, 2009

(65) Prior Publication Data

US 2011/0013399 A1 Jan. 20, 2011

(51) Int. Cl.
*F21V 33/00* (2006.01)

(52) U.S. Cl. ..... 362/547; 362/249.02; 362/294; 362/373; 362/545

(58) Field of Classification Search ..... 362/543, 362/544, 545, 547, 249.02, 311.02, 294, 362/373
See application file for complete search history.

(56) References Cited

U.S. PATENT DOCUMENTS 7,559,674 B2 * 7/2009 He et al. ..... 362/249.02
7,758,223 B2 * 7/2010 Osawa et al. ..... 362/547
2008/0112170 A1 * 5/2008 Trott et al. ..... 362/311
2010/0002453 A1 * 1/2010 Wu et al. ..... 362/373
2010/0027270 A1 * 2/2010 Huang et al. ..... 362/310

* cited by examiner

*Primary Examiner* — Laura Tso
(74) *Attorney, Agent, or Firm* — Alan Kamrath; Kamrath & Associates PA

(57) ABSTRACT

A thermal dispersing structure for LED or SMD LED lights is to mount a lamp base on a light head. The lamp base is funnel-shaped and has an interior annular cutout near its top edge. A substrate engages the annular cutout to carry one or multiple LED or SMD LED units at a center or other proper locations. Moreover, a rim is formed on the substrate around the LED or SMD LED units. The substrate has multiple holes defined corresponding to thermal conducting bases under the LED or SMD LED units and defined slightly larger or smaller than the LED thermal conducting base. Additionally, a thermal dispersing body is secured under the substrate and has multiple posts corresponding to the holes of the thermal conducting bases. Each post penetrates the substrate to snugly engage the thermal conducting base so that thermal dispersing efficiency is improved.

6 Claims, 27 Drawing Sheets projecting bulb

Replacement Sheet wide-angle light bulb

LED Luminance (spot light source)

1W LED
+light-adjusting lens (convex concave)=
surface light source 50° projecting angle

THERMAL DISPERSING STRUCTURE FOR LED OR SMD LED LIGHTS

BACKGROUND OF THE INVENTION

1. Field of the Invention

The present invention relates to a thermal dispersing structure, and more particularly to a thermal dispersing structure applied to LED or SMD LED lights.

2. Description of Related Art

Theoretically, light emitting diode (LED) is a light source has longest lifespan, lowest heat, lowest chemical pollution and electricity consumption so that application of LED is the major trend of present illumination having environmental and energy-saving efficiency.

However, taking LEDs to make a conventional bulb still has some drawbacks as below:

1. The conventional LED bulb is a spot light source and thus usually performs halation phenomenon. Unlike halide bulb and tungsten bulb which are line light sources or high-pressure sodium lamp or fluorescent lamp (such as fluorescent light tube, compact fluorescent lamp), HID bulbs which are activated by sodium, mercury or xenon elements to perform planar light source, the spot light source of LED causes uneven LUX with great drops to the projecting surfaces it projects thereto and has poor illumination uniformity in comparison with the fluorescent light tube, compact fluorescent lamp and tungsten bulb especially serving as reading lights (as shown in FIGS. 1 to 4).

2. The conventional LED illumination lights all embed one or multiple LED units into one or multiple V-shaped recesses in a heat sink base. Although the V-shaped recesses adjust the projecting angles of the light from LED units, wide-angle light is also interrupted and transformed to refraction light. In other words, light from LED spot light source out of direct light range within the V-shaped recess will be refracted by sidewalls therein to cause irregular and uneven fraction light which also damps the uniformity in illumination (as shown in FIGS. 5 and 6).

3. The conventional LED bulbs or lamps with high lumens all need heat sink base to disperse heat, wherein LED lamps having low watts (take 1 W as an example) can sufficiently disperse or conduct heat by attaching heat sink base (as shown in FIGS. 5 and 6). However, LED lamps having high watts (for example, 3 W or 5 W) or a small substrate collecting multiple 1 W LED units can not sufficiently disperses the high heat even by attaching the heat sink base made of copper or aluminum boards. Therefore, the conventional LED lamps cannot protect the LED units with chips within the limitation temperature (60 to 65° C.) to decrease their decay and thus to stabilize their lifespan.

SUMMARY OF THE INVENTION

A main objective of the present invention is to provide a thermal dispersing structure for LED or SMD LED lights that has excellent heat dispersing efficiency.

To achieve the foregoing objective, the thermal dispersing structure comprises:

a lamp base being a funnel shape mounted on the lamp head and having an enlarged top edge with an annular cutout defined near the enlarged top edge;

a substrate engaged the annular cutout and having at least one LED or SMD LED units each with at least one thermal conducting base and at least one hole defined on the substrate to receive the at least one thermal conducting base correspondingly; and a thermal dispersing body attached under the substrate and having at least one post penetrating a corresponding one of the at least one hole to engage a corresponding one of the at least one thermal conducting base.

Further benefits and advantages of the present invention will become apparent after a careful reading of the detailed description with appropriate reference to the accompanying drawings.

BRIEF DESCRIPTION OF THE DRAWINGS

FIG. 9-1 is cross-sectional view of the thermal dispersing structure mounted on a fluorescent light tube;

FIG. 9-2 is cross-sectional view of the thermal dispersing structure mounted on a dual-socket light tube;

FIG. 12-1 is a top view of the thermal dispersing structure showing the rim around the multiple LED units or the multiple SMD LED units;

FIG. 16-1 is a schematic drawing showing LUX and light uniformity rate of LED or SMD LED lamp with a concave-convex lens served as a spotlight in accordance with the present invention;

FIG. 18-1 is a cross-sectional side view of the car headlamp combination along line A-A';

FIG. 19-1 is a cross-sectional side view of the two-way projection light;

FIG. 20-1 is a bottom view of the road light or the decorative projecting lamp; and FIG. 20-2 is a cross-sectional side view of the road light or the decorative projecting lamp.

DETAILED DESCRIPTION OF THE PREFERRED EMBODIMENT

A thermal dispersing structure for LED or SMD LED lights in the present invention is to mount a lamp base at a light head. The lamp base is funnel-shaped and has an interior annular cutout near its top edge. A substrate engages the annular cutout to carry one or multiple LED or SMD (surface-mount device) LED units at a center or other proper locations. Moreover, a rim is formed on the substrate around the LED or SMD LED units. The substrate has multiple holes defined corresponding to thermal conducting bases under the LED or SMD LED units and defined slightly larger or smaller than the LED thermal conducting bases. Additionally, a thermal dispersing body is secured under the substrate and has multiple posts corresponding to the holes of the substrate. Each post penetrates the substrate to snugly engage one thermal conducting base so that thermal dispersing efficiency is improved.

Figure 1:
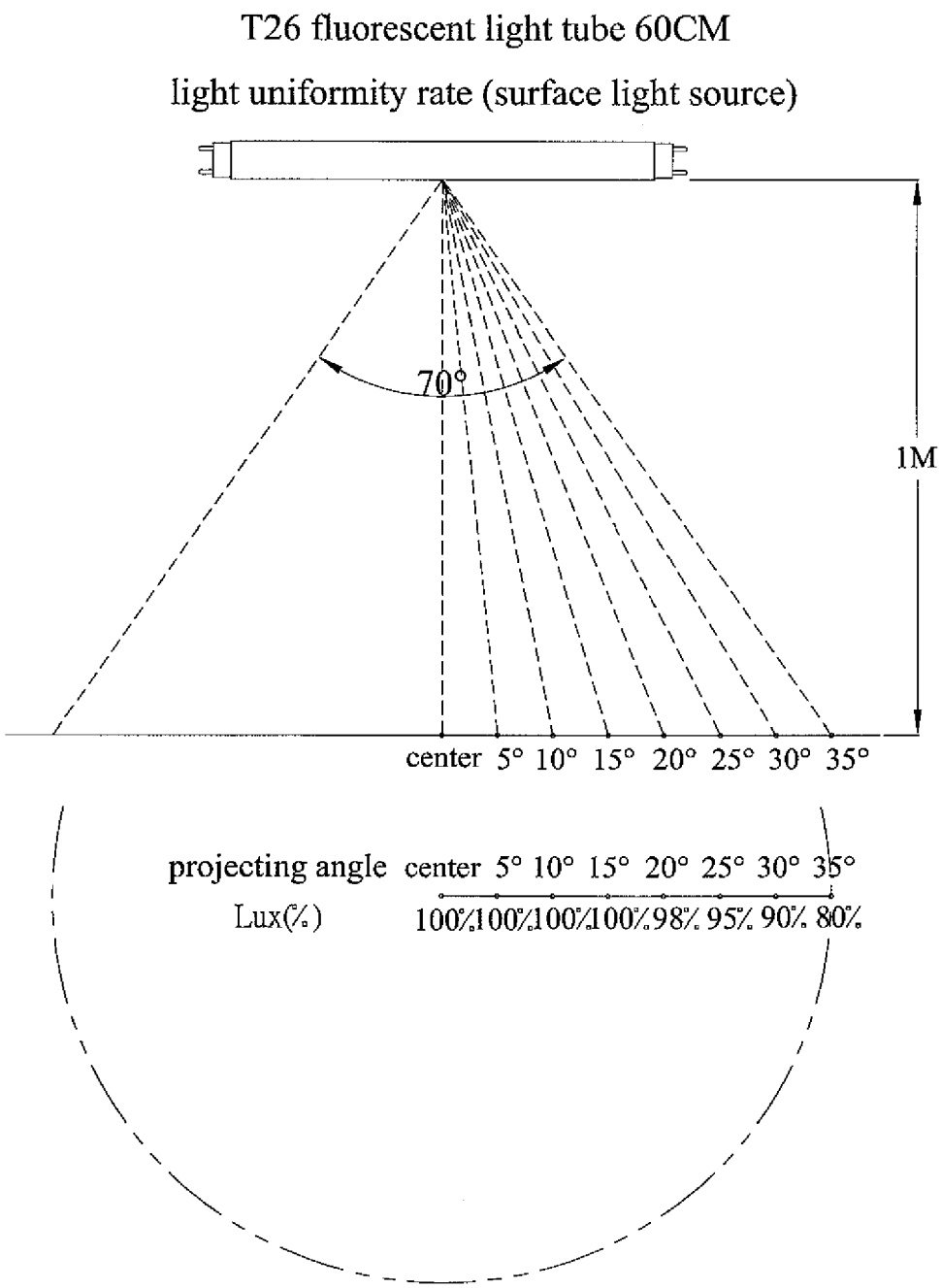
FIG. 1 PRIOR ART
FIG. 1 is a schematic drawing showing the light uniformity rate of a fluorescent light tube from side and corresponding top in accordance with the prior art.
Figure 2:
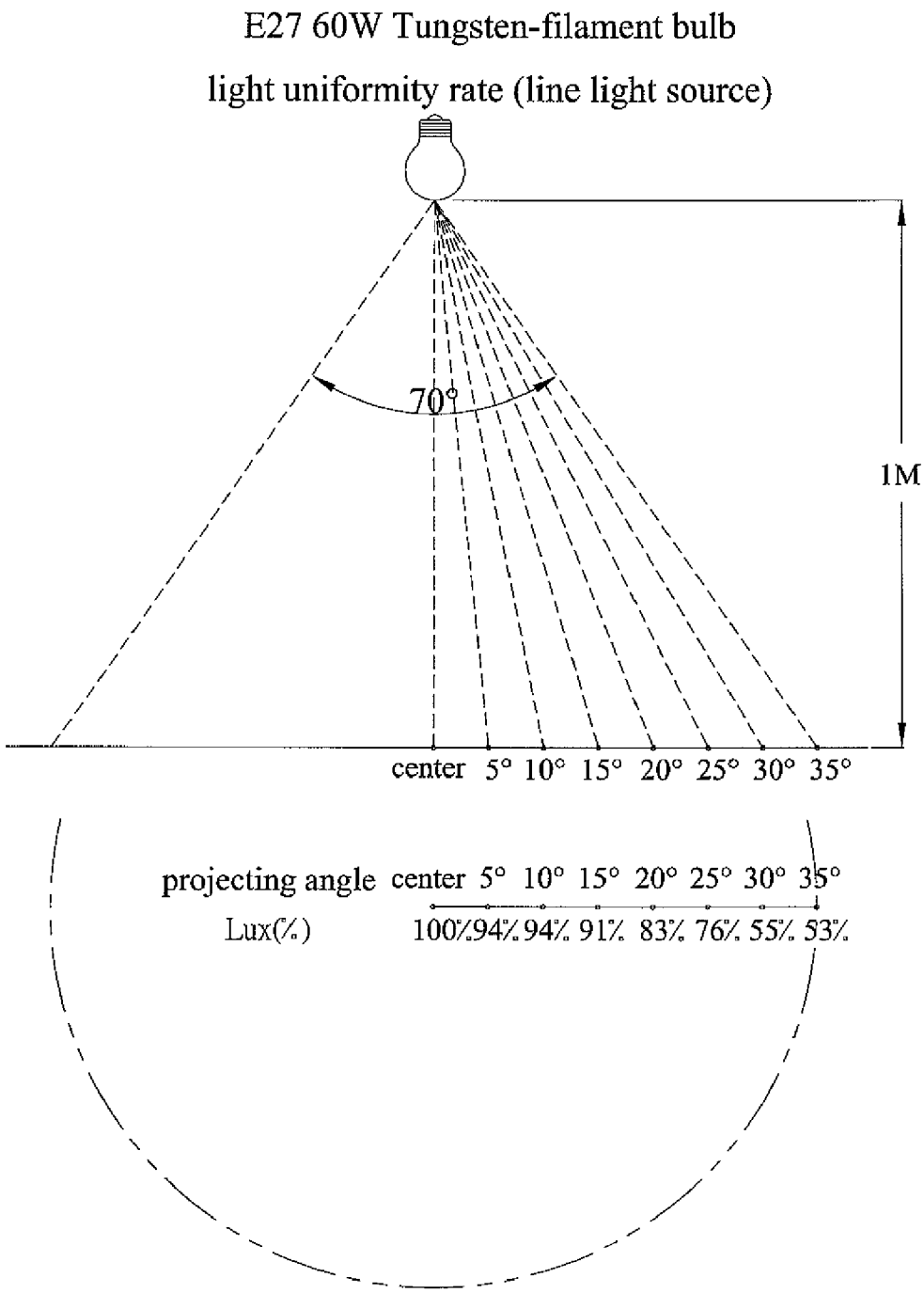
FIG. 2 PRIOR ART
FIG. 2 is a schematic drawing showing the light uniformity rate of a tungsten bulb from side and corresponding top in accordance with the prior art.
Figure 3:
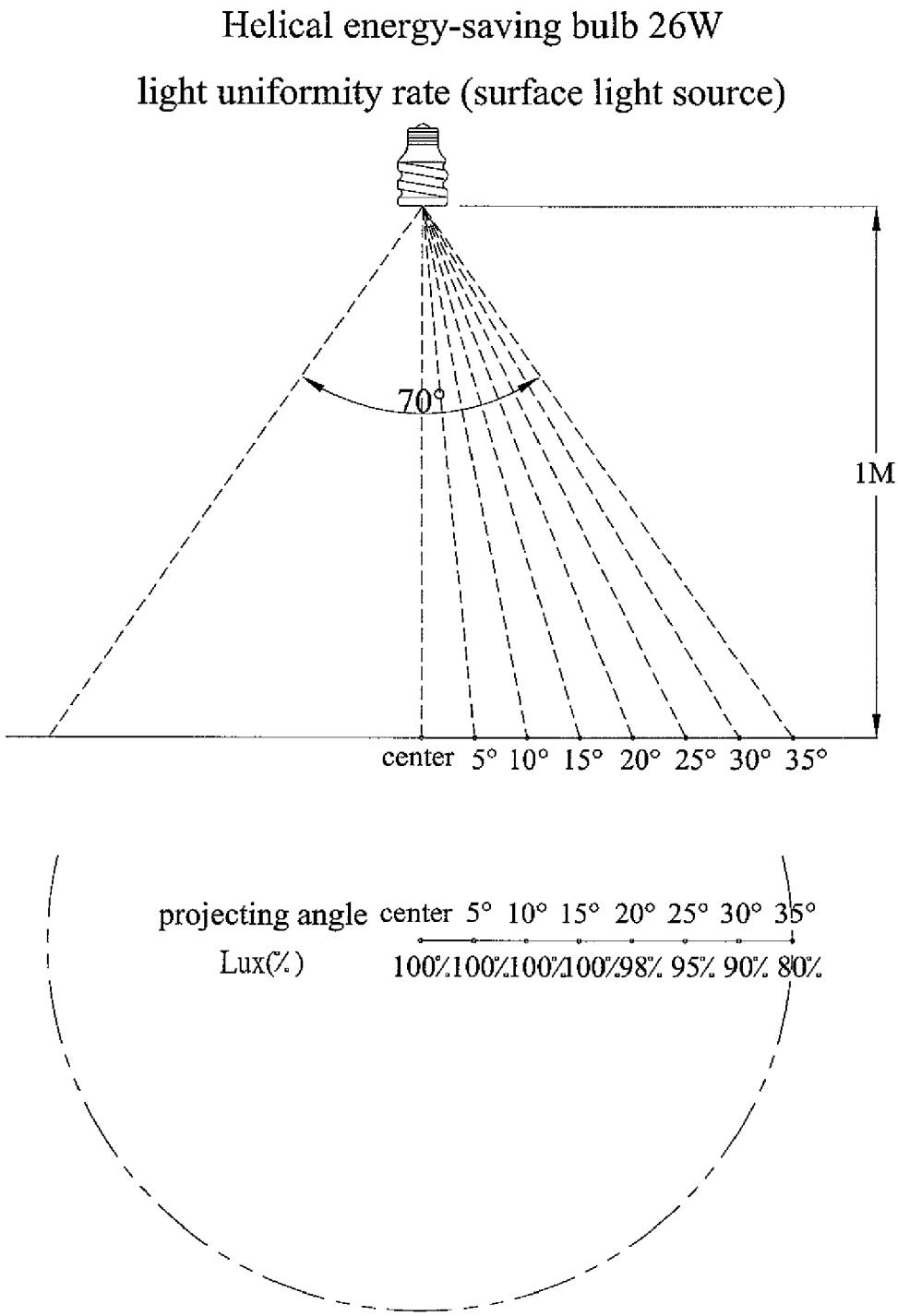
FIG. 3 PRIOR ART
FIG. 3 is a schematic drawing showing the light uniformity rate of a helical compact fluorescent lamp from side and corresponding top in accordance with the prior art.
Figure 4:
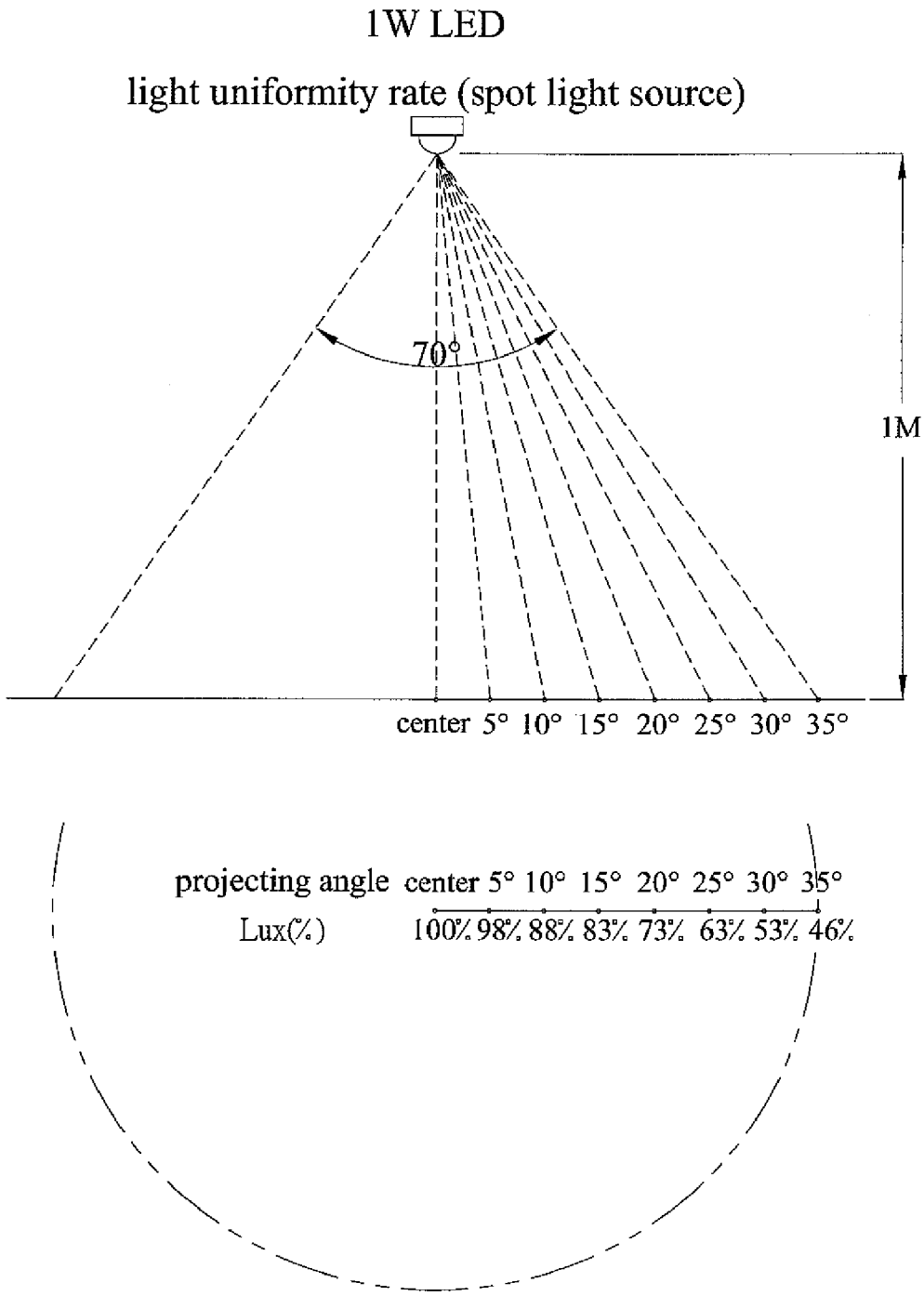
FIG. 4 PRIOR ART
FIG. 4 is a schematic drawing showing the light uniformity rate of a LED lamp from side and corresponding top in accordance with the prior art.
Figure 5:
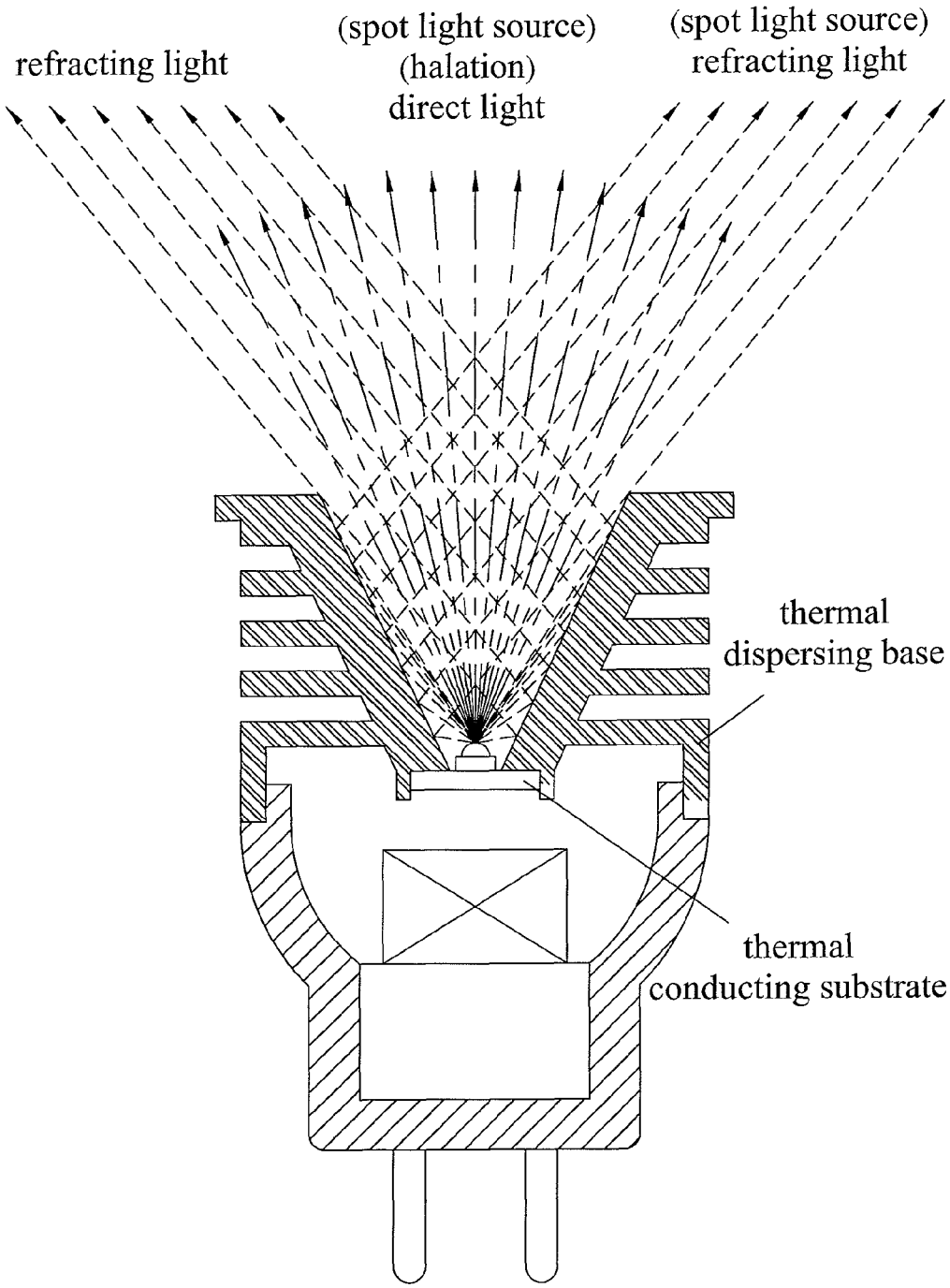
FIG. 5 PRIOR ART
FIG. 5 is a schematic side drawing showing the light projection of a LED unit within a V-shaped recess of a heat sink in accordance with the prior art.
Figure 6:
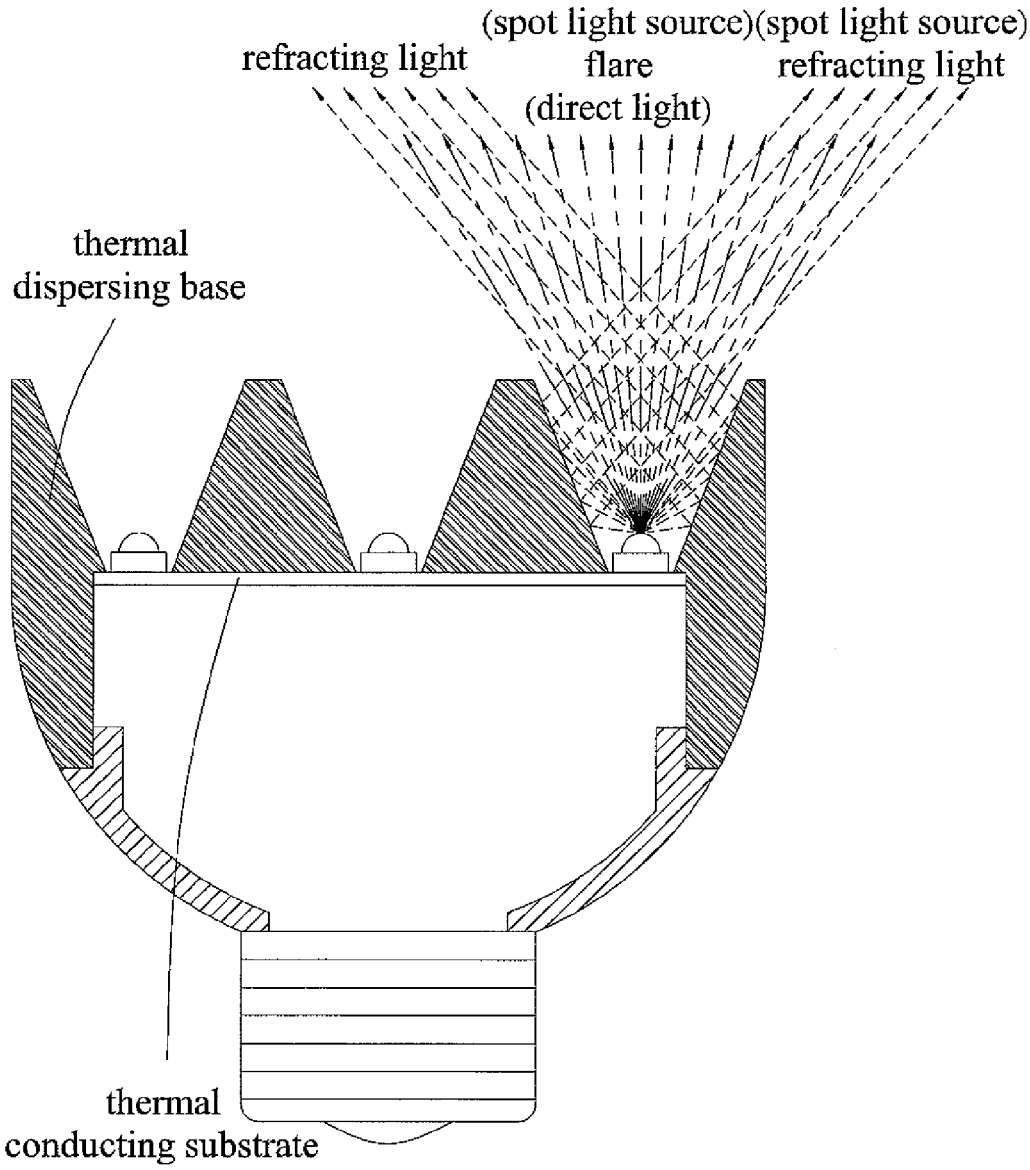
FIG. 6 PRIOR ART
FIG. 6 is a schematic side drawing showing the light projection of a LED unit within one of multiple V-shaped recesses of a heat sink in accordance with the prior art.
Figure 7:
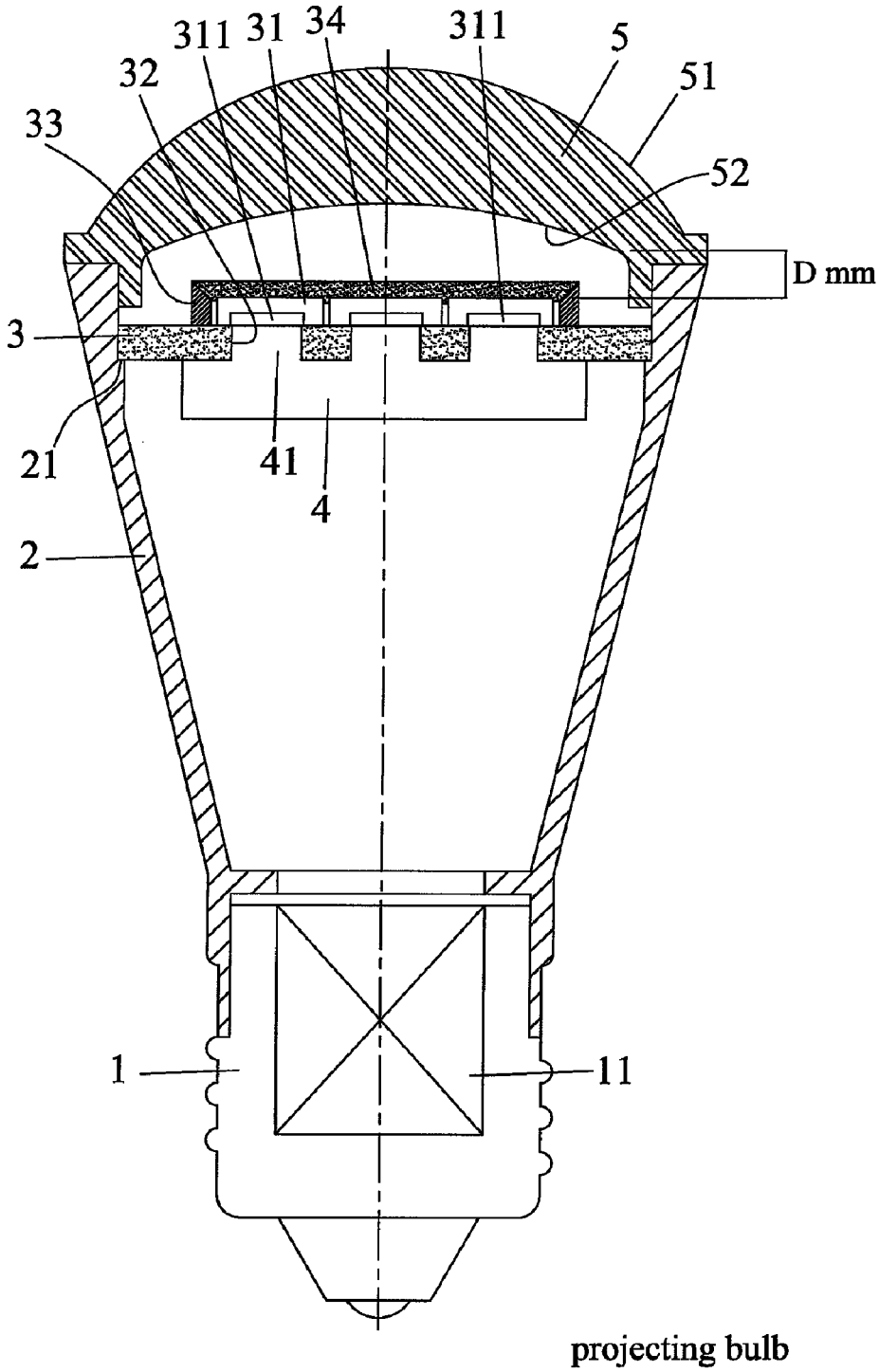
FIG. 7 is a cross-sectional side view of a thermal dispersing structure for LED or SMD LED lights served as a spotlight in accordance with the present invention.
Figure 8:
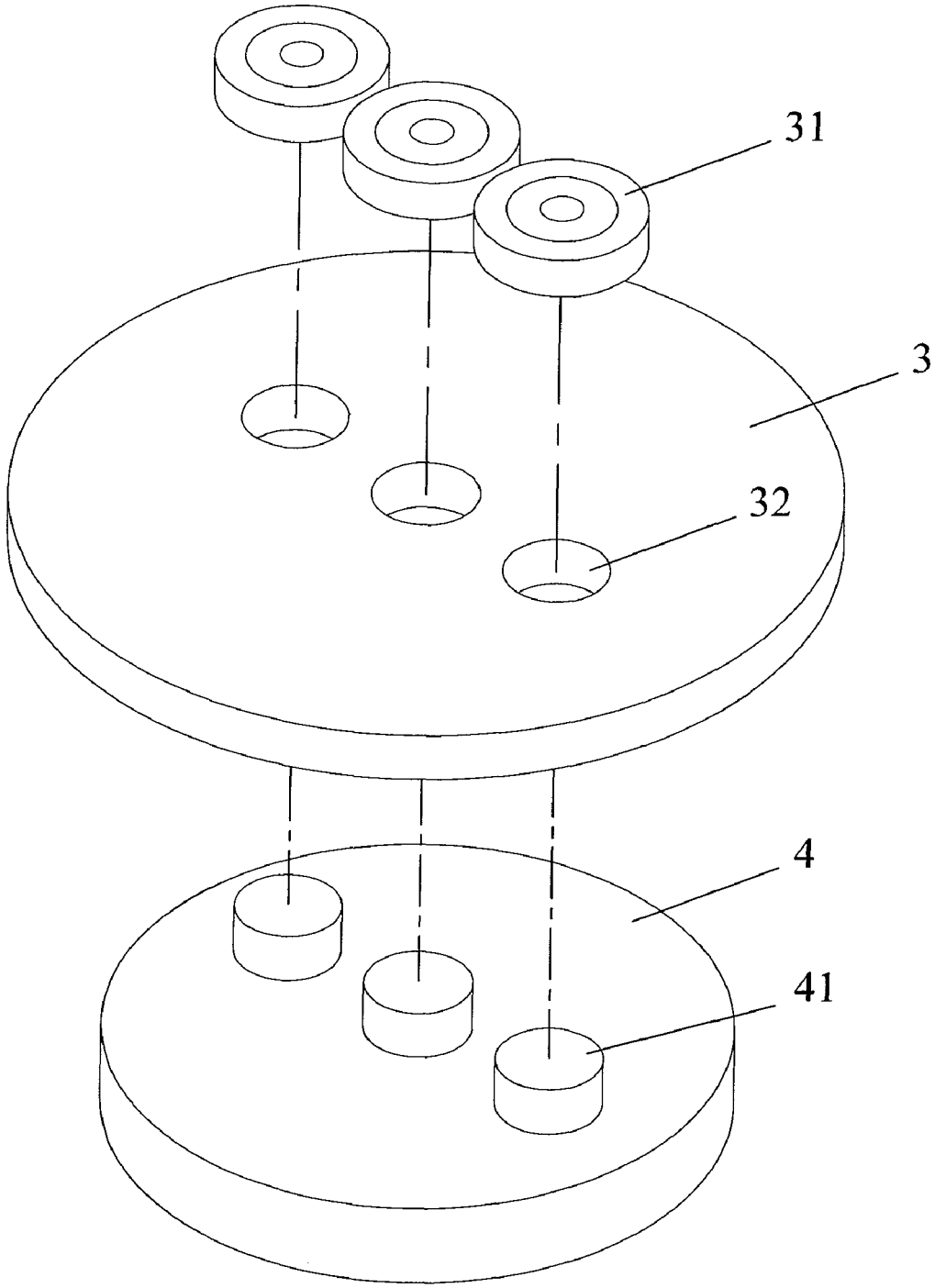
FIG. 8 is an exploded perspective view of the LED unit, substrate and thermal dispersing body in accordance with the present invention.
Figure 9:
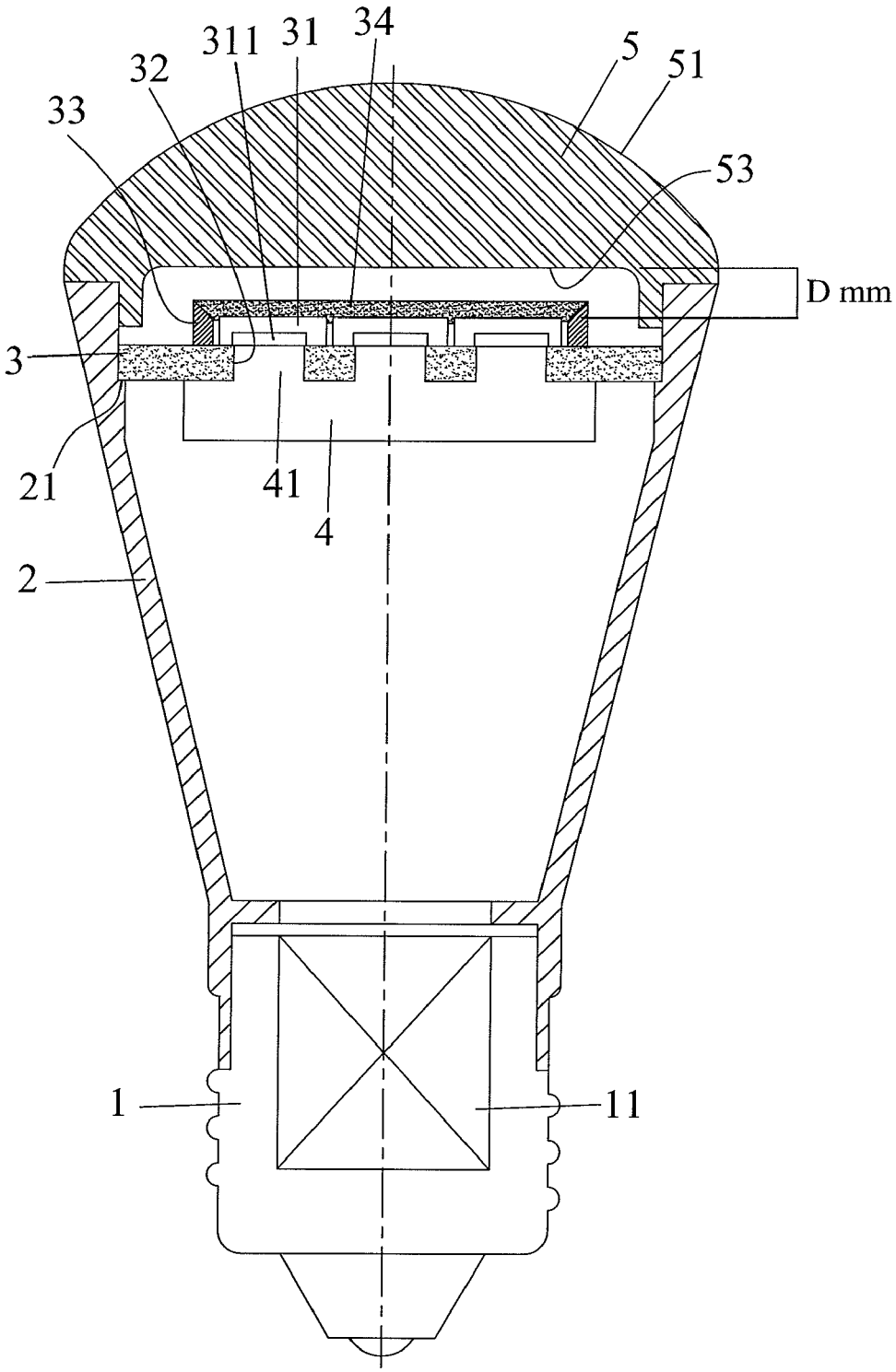
FIG. 9 is a cross-sectional side view of a thermal dispersing structure for is LED or SMD LED lights served as a wide-angle light in accordance with the present invention.
Figures 1, 9:
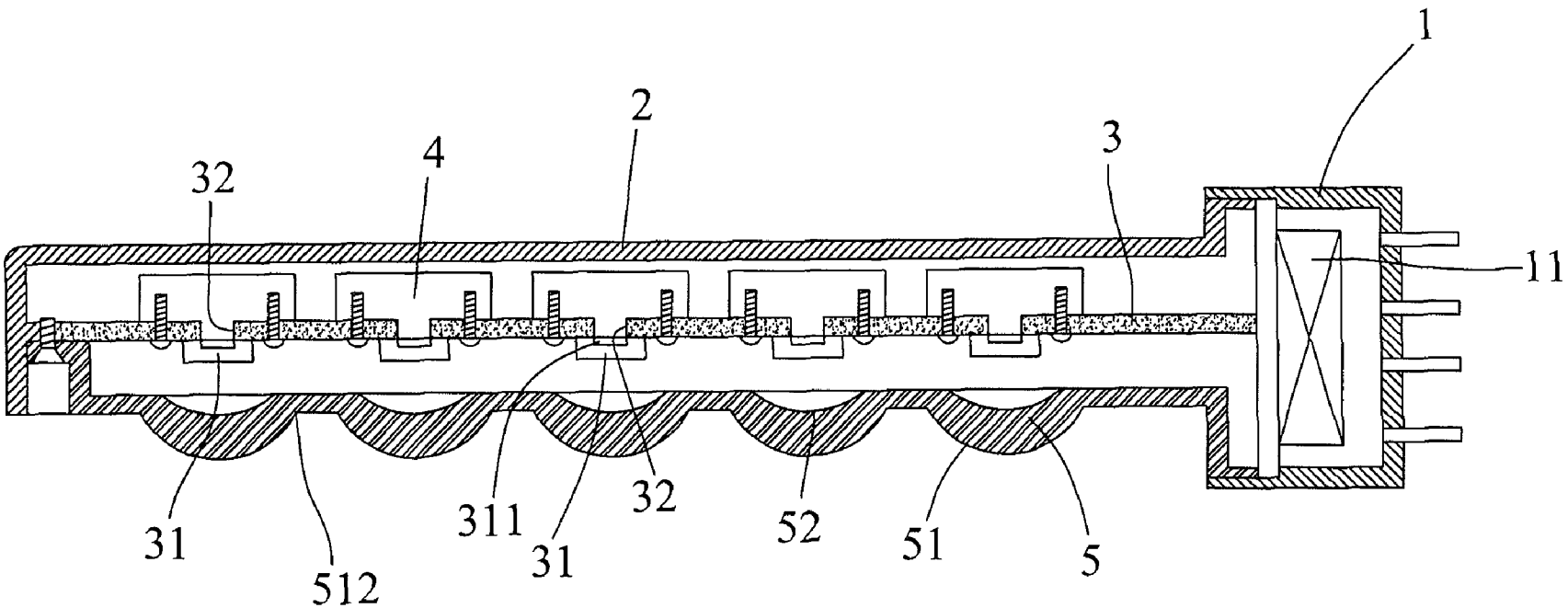
Figures 2, 9:
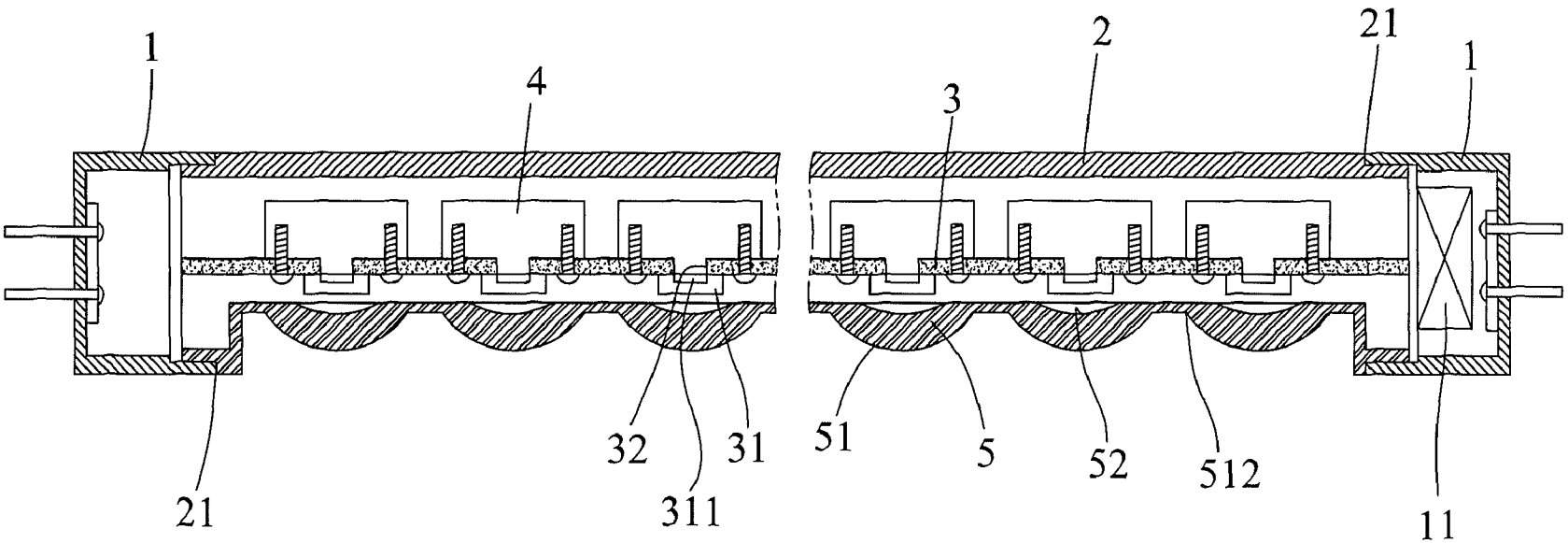
Figure 12:
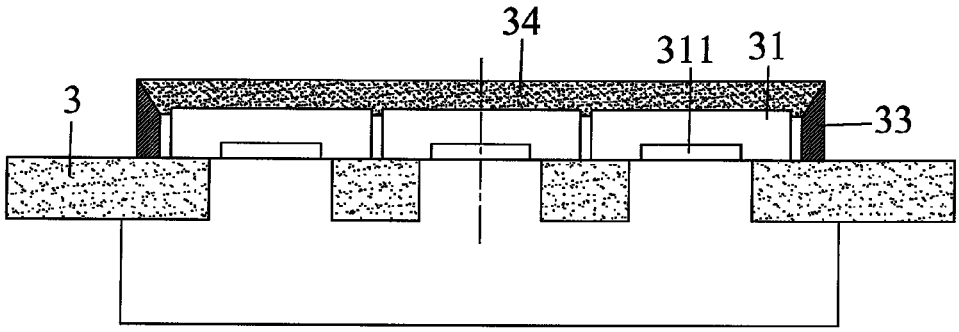
FIG. 12 is a partially cross-sectional view of the thermal dispersing structure showing a rim around multiple LED units or multiple SMD LED units.
Figures 1, 12:
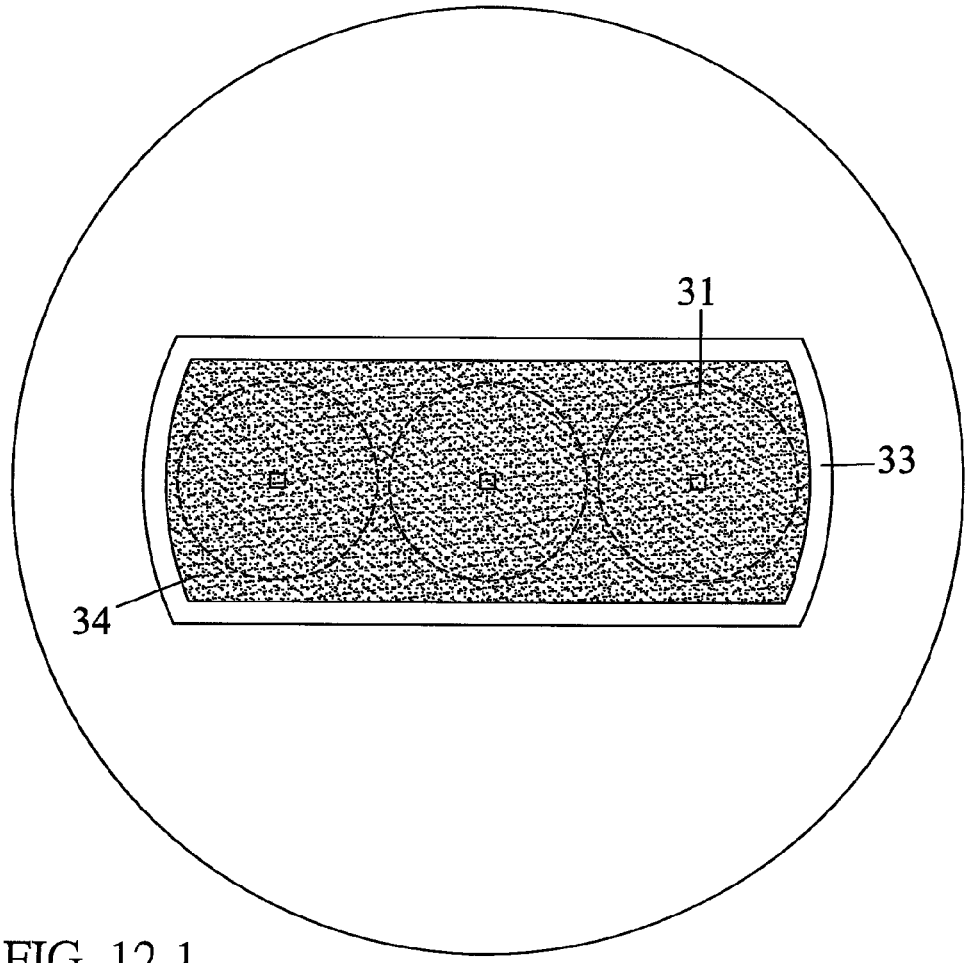
Figure 15:
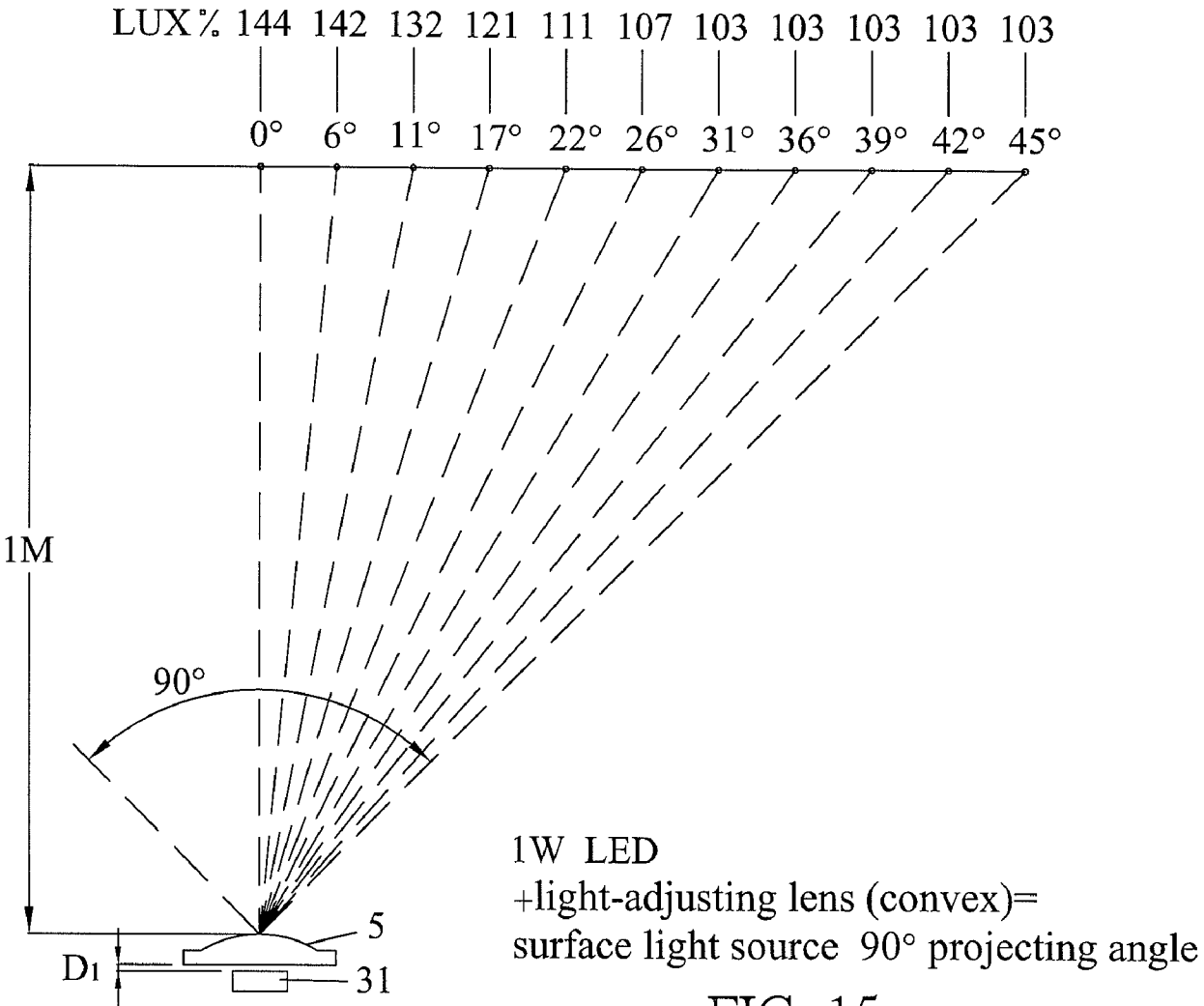
FIG. 15 is a schematic drawing showing LUX and light uniformity rate of LED or SMD LED lamp with a convex lens served as a wide-angle light in accordance with the present invention.
Figure 16:
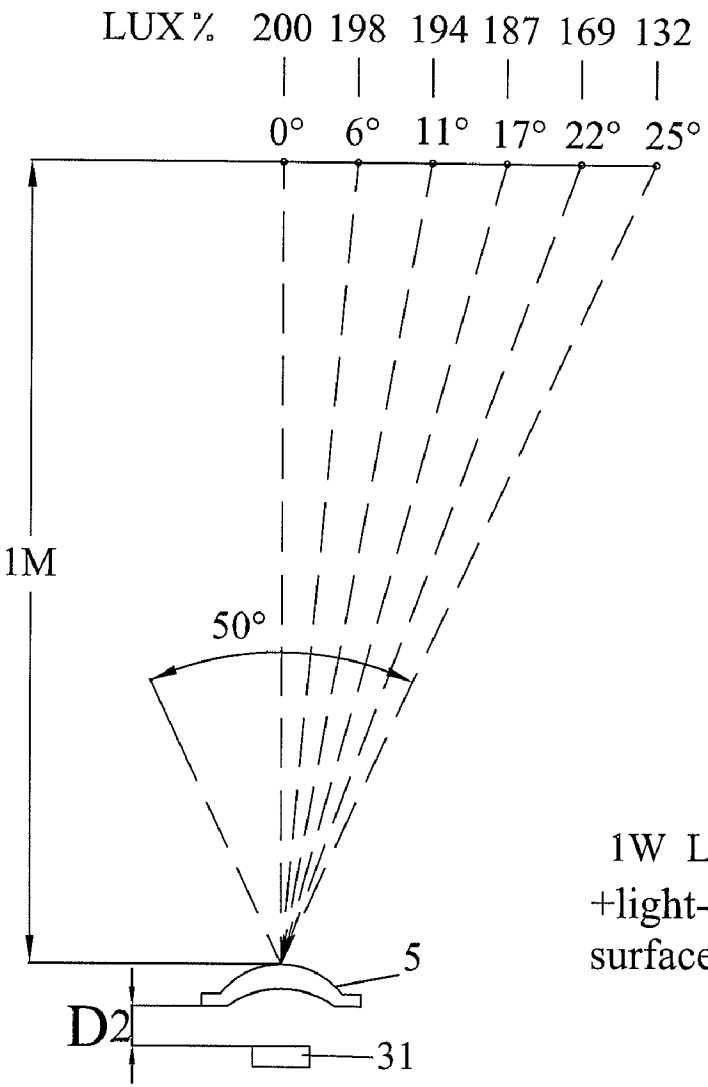
FIG. 16 is a schematic drawing showing LUX and light uniformity rate of LED or SMD LED lamp with a concave-convex lens served as a wide-angle light in accordance with the present invention.
Figures 1, 16:
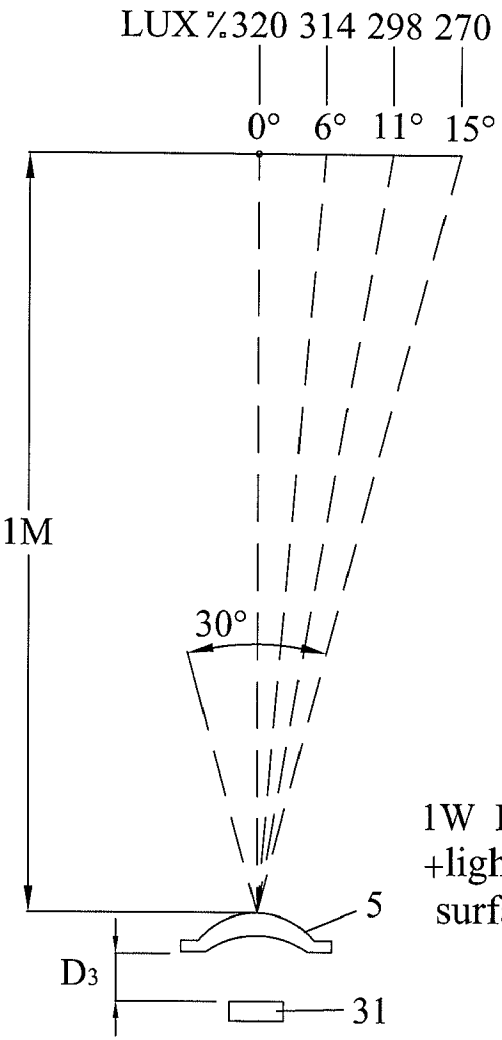
Figure 20:
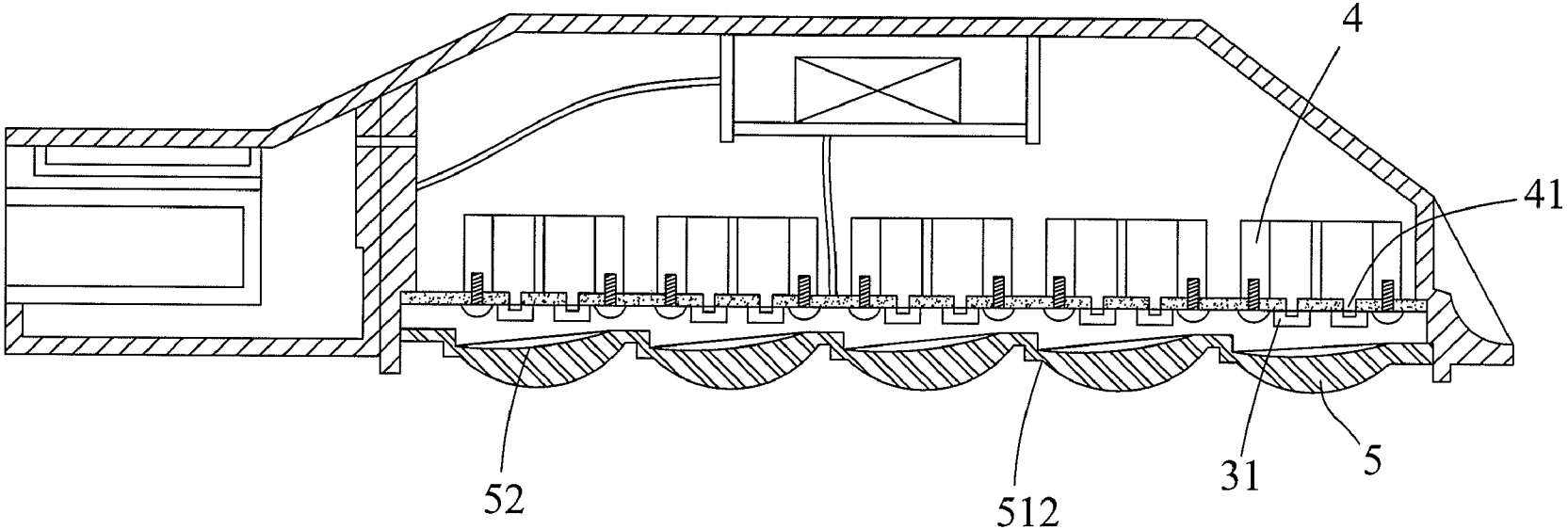
FIG. 20 is a cross-sectional side view of the thermal dispersing structure attached to a road light or a decorative projecting lamp.
Figures 1, 20:
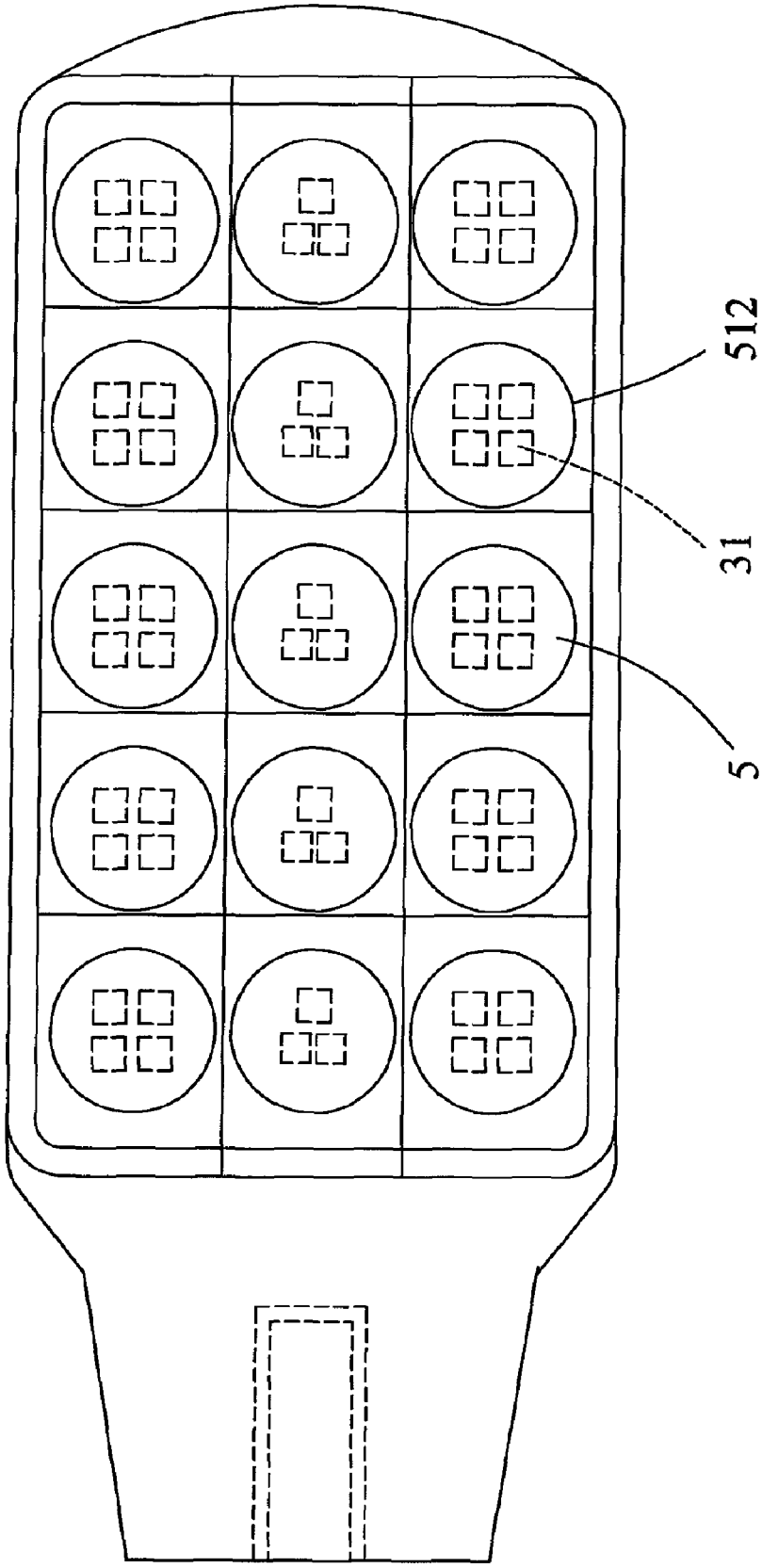
Figures 2, 20:
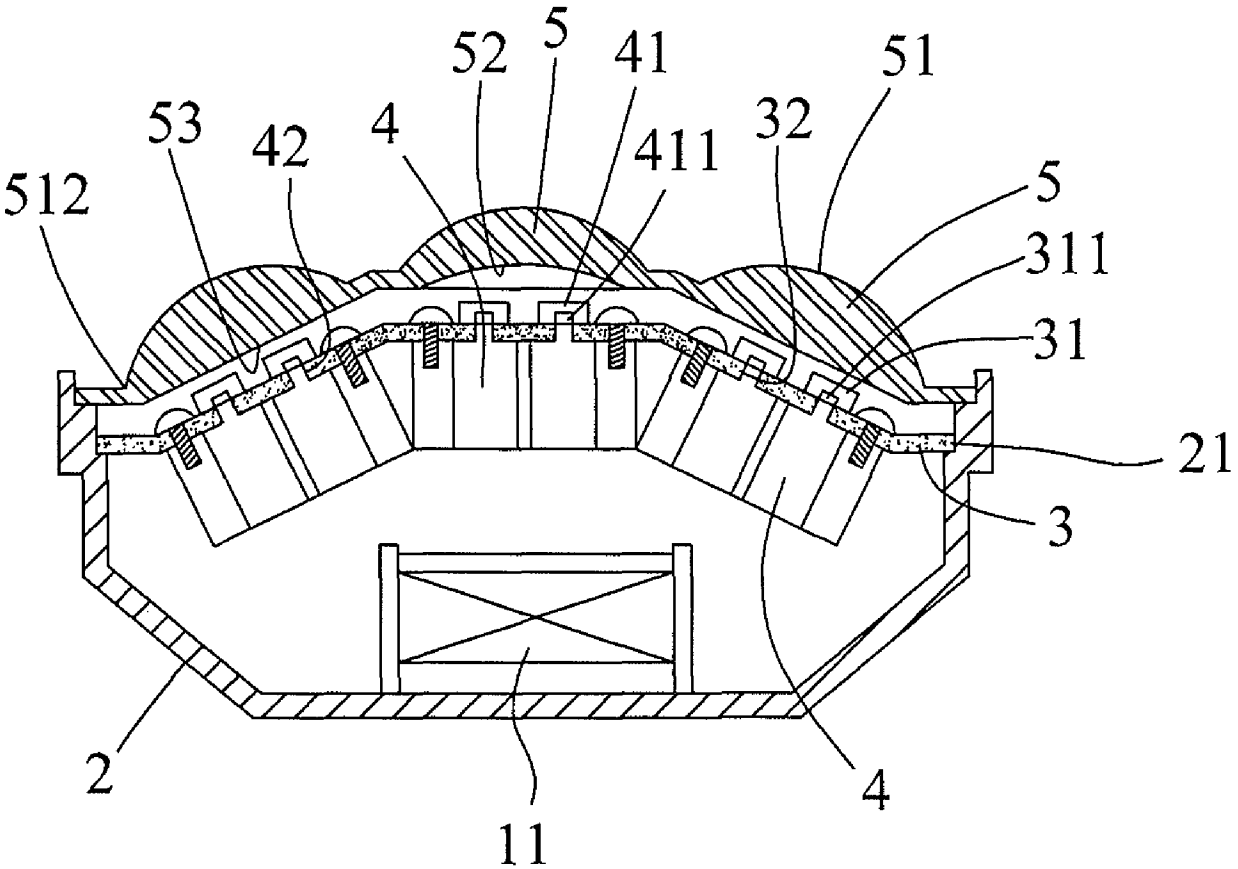

As shown in FIGS. 7 and 9, a preferred embodiment of the thermal dispersing structure is to mount a lamp base 2 to a lamp head 1 which has a vertoro driver 11. The lamp base 2 is funnel-shaped and has an enlarged top edge and an annular cutout 21 defined near the enlarged top edge inside the lamp base 2. A substrate 3 is received inside the annular cutout 21 and has at least one LED or SMD LED units 31 at its center or other proper locations thereon. The substrate 3 has multiple holes 32 corresponding to multiple thermal conducting bases 311 under the LED or SMD LED units 31. Moreover, a thermal dispersing body 4 is secured under the substrate 3 and is made of conductive material in any shapes or size. The thermal dispersing body 4 in FIG. 8 has multiple posts 41 with high thermal conductive efficiency penetrating the holes 32 corresponding to the thermal conducting bases 311 of the LED or SMD LED units 31. Each post 41 has a height slightly higher than a thickness of the substrate 3 and has an outer diameter slightly smaller than an inner diameter of a corresponding hole 32 of the substrate 3. Moreover, the periphery of the posts 41 is coated with thermal conductive glue and the thermal dispersing body 4 is secured on the substrate 3. As shown in FIGS. 12 and 12-1, a rim 33 is formed on the substrate 3 around the LED or SMD LED units 31 and is selectively shaped to different variation according to arrangements of LED or SMD LED units 31. The rim 33 has a top slope inclined inwardly and having its top end higher than a top level of the LED or SMD LED units 31 and its bottom end lower than the top level of the LED or SMD LED units 31. The light-conducting glue 34 is filled within the rim 33 over the LED or SMD LED units 31, wherein the light-conducting glue 34 performs a layer having a top surface higher than the top level of the LED or SMD LED units 31. Thereby, light emitting from spot light source of the LED or SMD LED units 31 is reflected and collected by the light-conducting glue 34 and inner surfaces of the rim 33 to perform initial surface light source to increase luminance and improve light uniformity. Moreover, the lamp base 2 has a top and a light-adjusting lens 5 mounted at the top over the LED or SMD LED units 31. The light-adjusting lens 5 selectively has an outer convex arc 51 at its upper surface and an inner concave arc 52 at its lower surface as shown in FIG. 7. Otherwise, as shown in FIG. 9, the lower surface of the light-adjusting lens is an inner planar surface. The inner concave arc 52 and the inner planar surface 53 (shown in FIG. 20-2) both are treated with foggy treatment or laminated with foggy paper. Moreover, distance D between the light-adjusting lens 5 and the LED or SMD LED units 31 is adjustable (as shown in FIGS. 7 and 9). For example, (as shown in FIGS. 16 and 16-1), when the distances D2, D3 between the light-adjusting lens 5 and the LED or SMD LED units 31 are 3 to 10 mm, the light-adjusting lens 5 creates lighting efficiency as a spotlight. As shown in FIG. 15, when the distances D1 between the light-adjusting lens 5 and the LED or SMD LED units 31 is 0 to 2.5 mm, the light-adjusting lens 5 creates lighting efficiency as a wide-angle lamp. Additionally, as shown in FIG. 9-1, the thermal dispersing structure in this invention is operationally applied to a single-socket light tube or, as shown in FIG. 9-2, applied to a dual-socket light tube.

Figure 10:
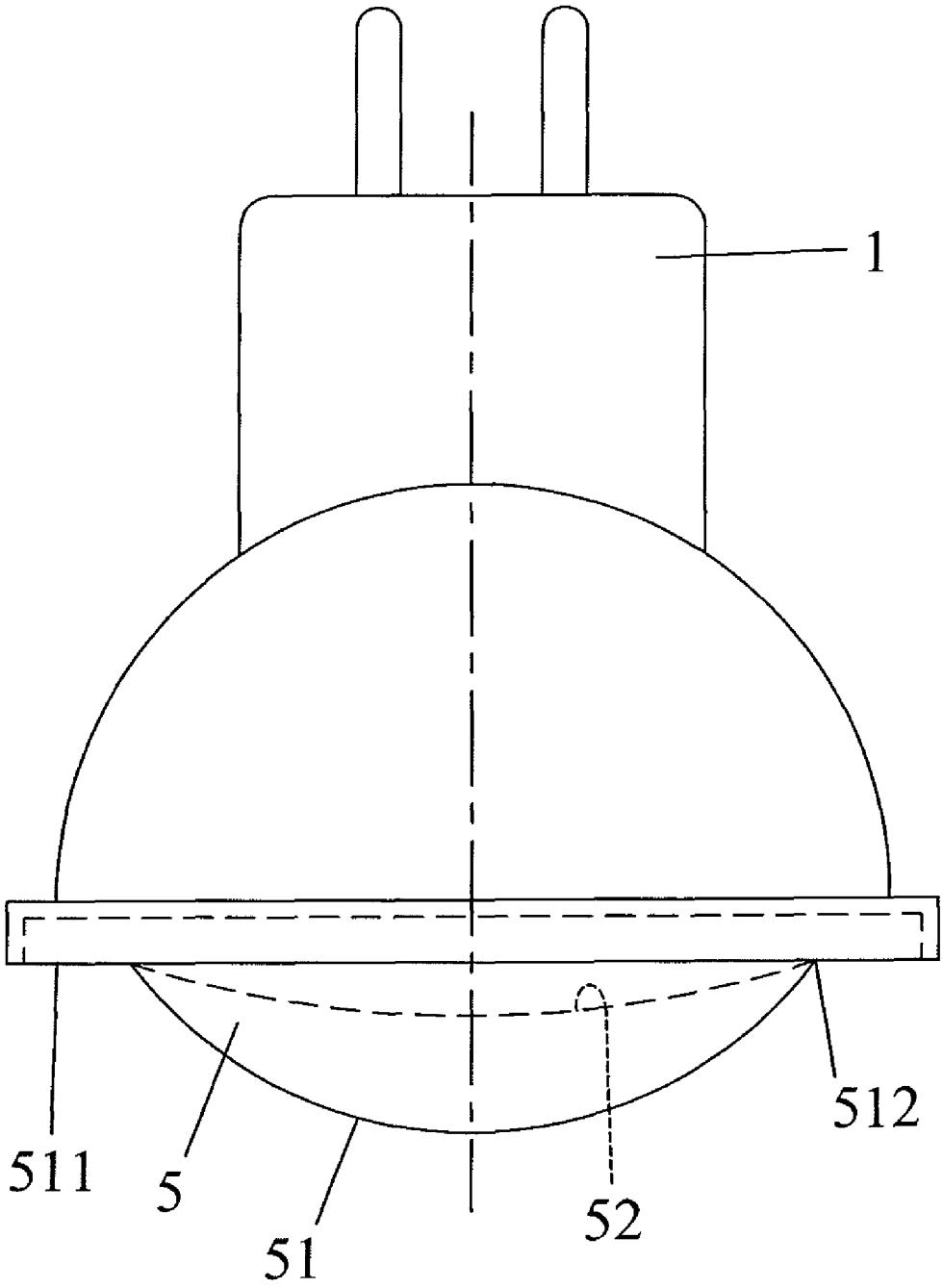
FIG. 10 is a partially cross-sectional view of a planar connector of an adjusting lens to combine with a convex.

As shown in FIG. 10, the outer convex arc 51 of the light-adjusting lens 5 has its edge performing a planar connector 511, wherein the connection between the outer convex arc 51 and the planar connector 511 is a sharp attachment 512. Thereby, luminance outside the projecting angle range is increased.

Figure 11:
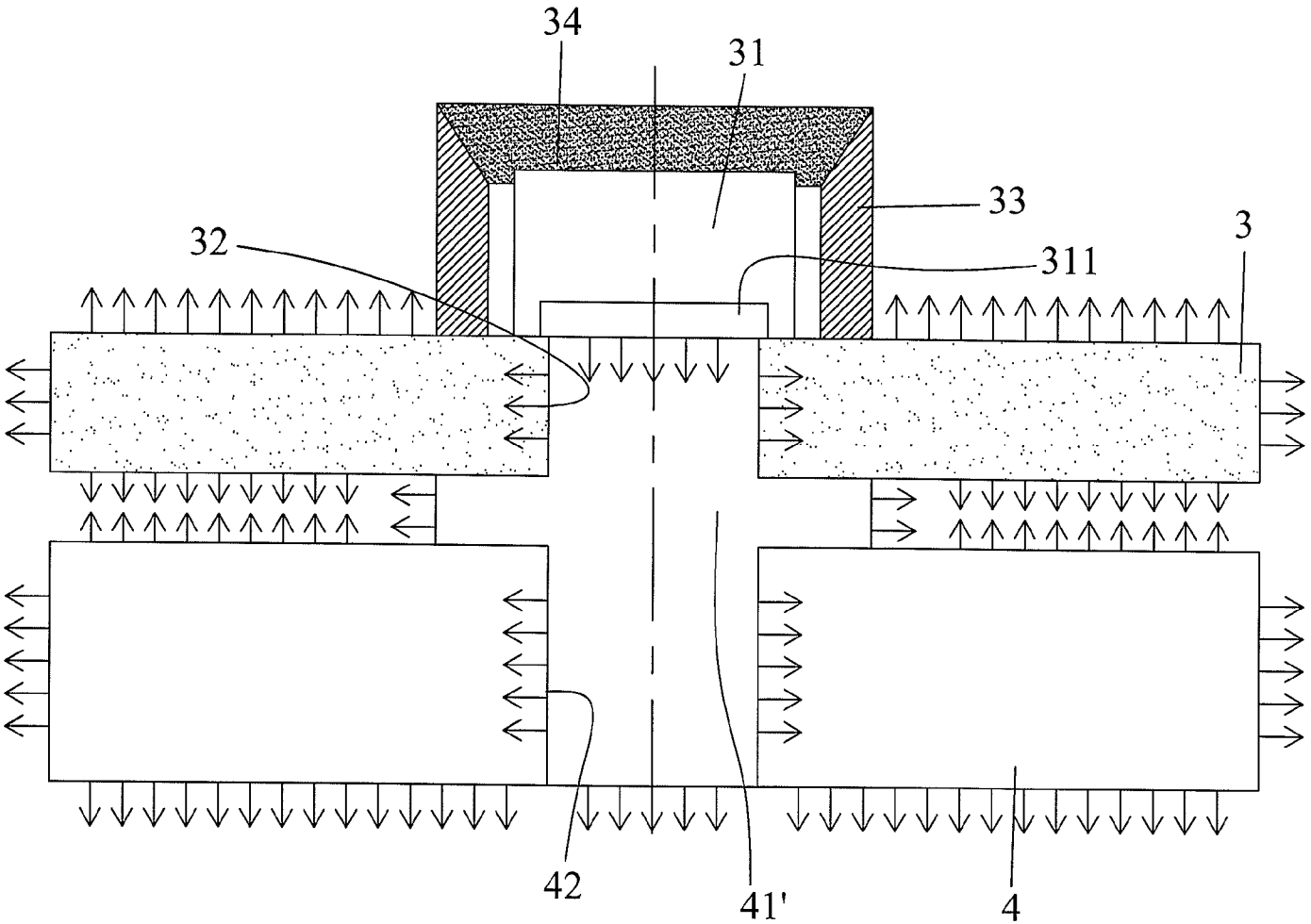
FIG. 11 is a schematic cross-sectional view showing the radial dispersion of the thermal dispersing body and a post combined into a set.

As shown in FIG. 11, the high-conductive posts 41 on the thermal dispersing body 4 are separately created as a sleeving set, i.e. the thermal dispersing body 4 further has multiple engaging holes 42 aligning to the holes 32 on the substrate 3 under the thermal conducting base 311 of LED or SMD LED units 31. Moreover, a cross-shaped thermal conducting post 41' is clamped between the substrate 3 and the thermal dispersing body 4 and connects to the holes 32 and the engaging holes 42 respectively to service as interface to sufficiently conduct and disperse heat. The described cross-shaped thermal conducting post 41' is made of thermal dispersing material with excellent thermal conducting efficiency and the thermal dispersing body 4 is selectively made of thermal dispersing material with less thermal conducting efficiency than the one of thermal conducting post 41'. Thereby, heat generated by the LED or SMD LED units 31 is radially dispersed by large surface of the steric periphery of the thermal conducting post 41' and then remained heat is quickly passed to and dispersed by large surface of the thermal dispersing body 4. Unlike conventional LED light only has small thermal transmitting spot, the thermal dispersing structure with thermal conducting post 41' enables to rapidly conduct and disperse high heat along X, Y, Z axles.

Figure 13:
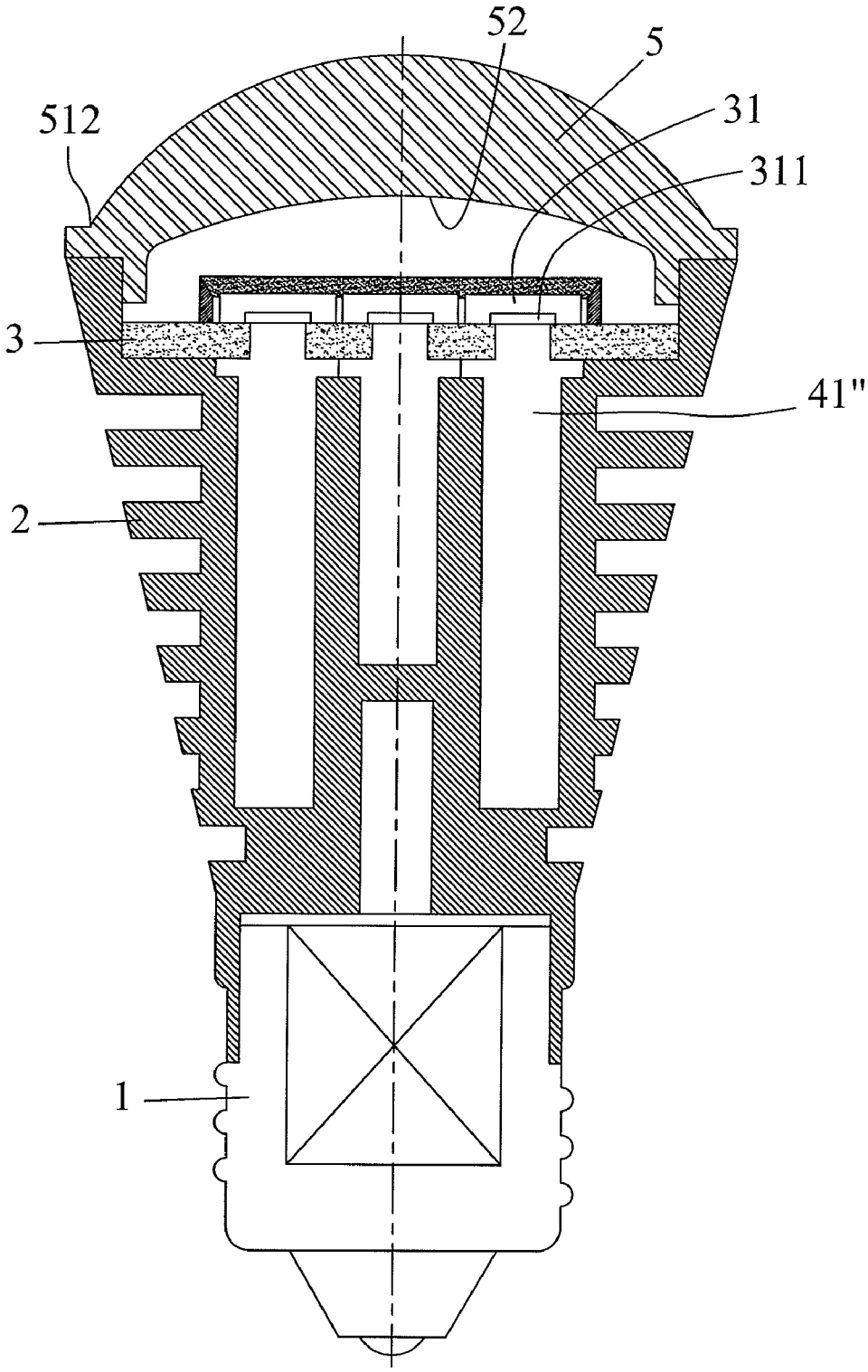
FIG. 13 is a cross-sectional side view of a metal socket in accordance with the present invention.
Figure 14:
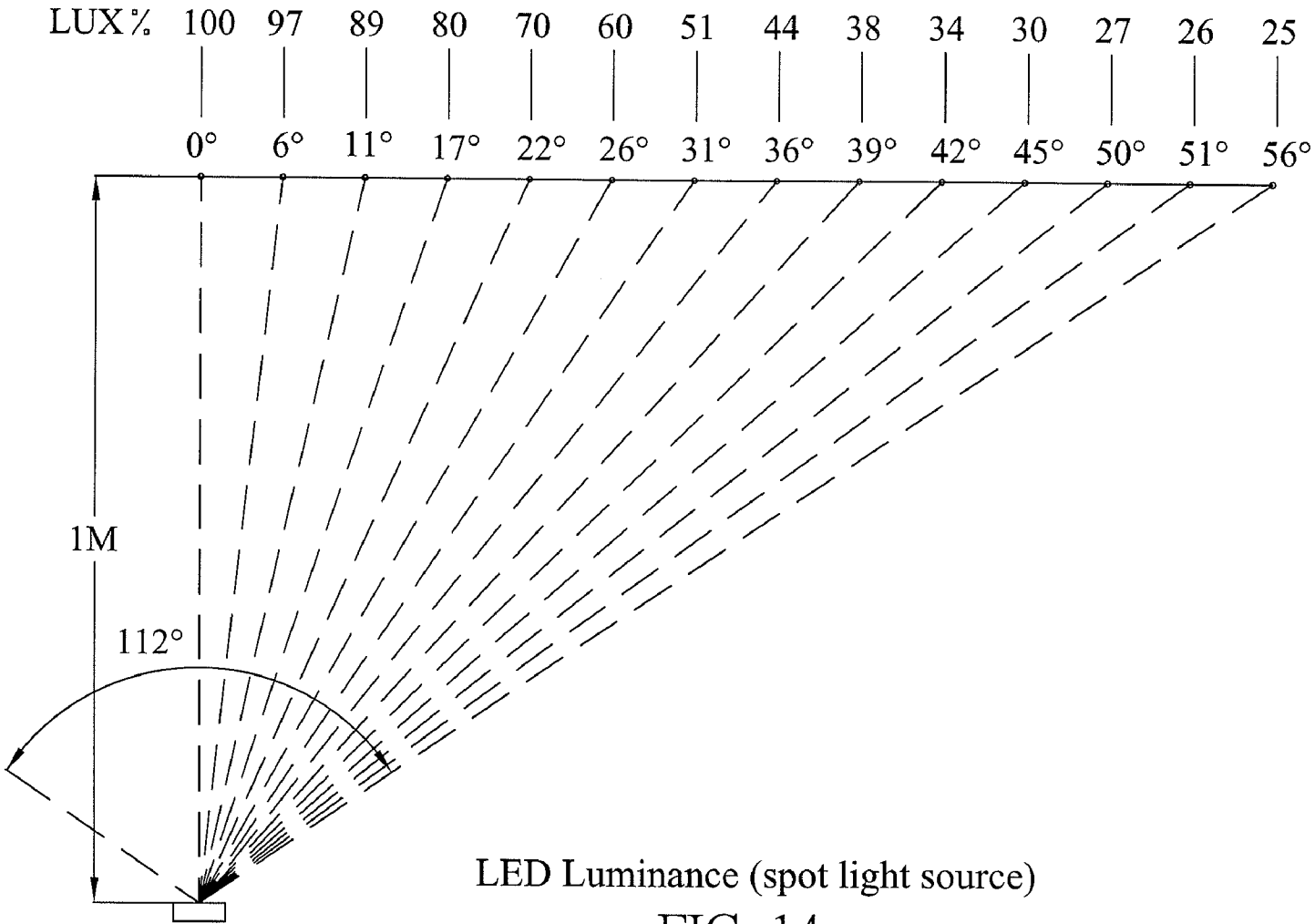
FIG. 14 is a schematic drawing showing LUX and light uniformity rate of LED or SMD LED lamp in accordance with the present invention.

As shown in FIG. 13, the lamp base 2 is integrally made of metal thermal dispersing base and contains an enlarged thermal conducting post 41" to make the largest surface and largest volume for thermal dispersion for high illumination or combination of large quantity of LED or SMD LED units 31 with high power consumption.

The foregoing light head 1 is selectively in form of a threaded type, a wedging type, a plug type or a T-shaped rotation lock (such as T-shaped rotation lock in the fluorescent light tube) etc.

The foregoing thermal dispersing body 4, the posts 41, the thermal conducting post 41', 41", or the lamp base 2 are made of thermal dispersing material such as aluminum, copper or nano-ferric ceramic in one-piece or in a sleeving piece.

Figure 17:
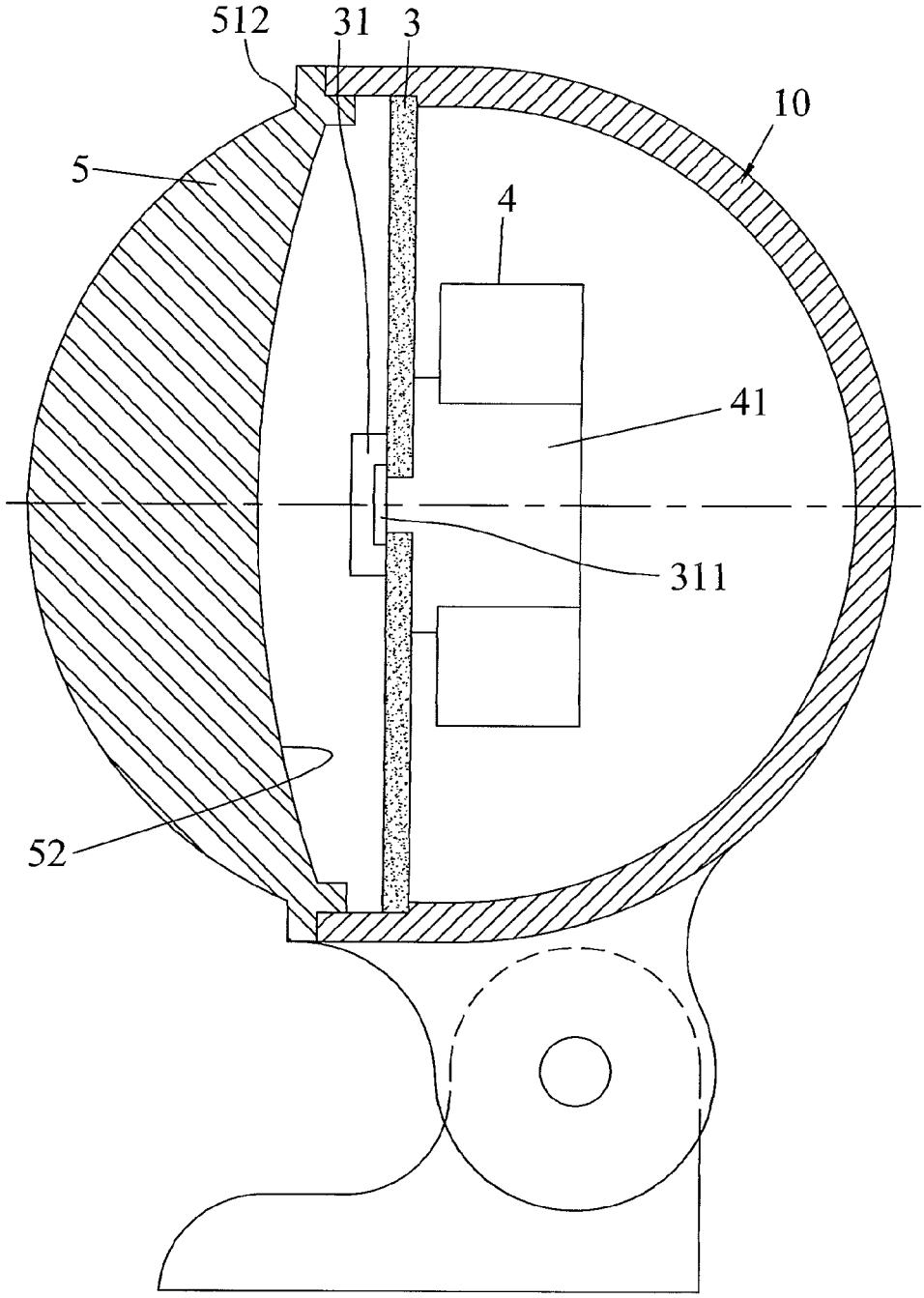
FIG. 17 is a cross-sectional side view of the thermal dispersing structure attached to a singular light of a car lamp.
Figure 18:
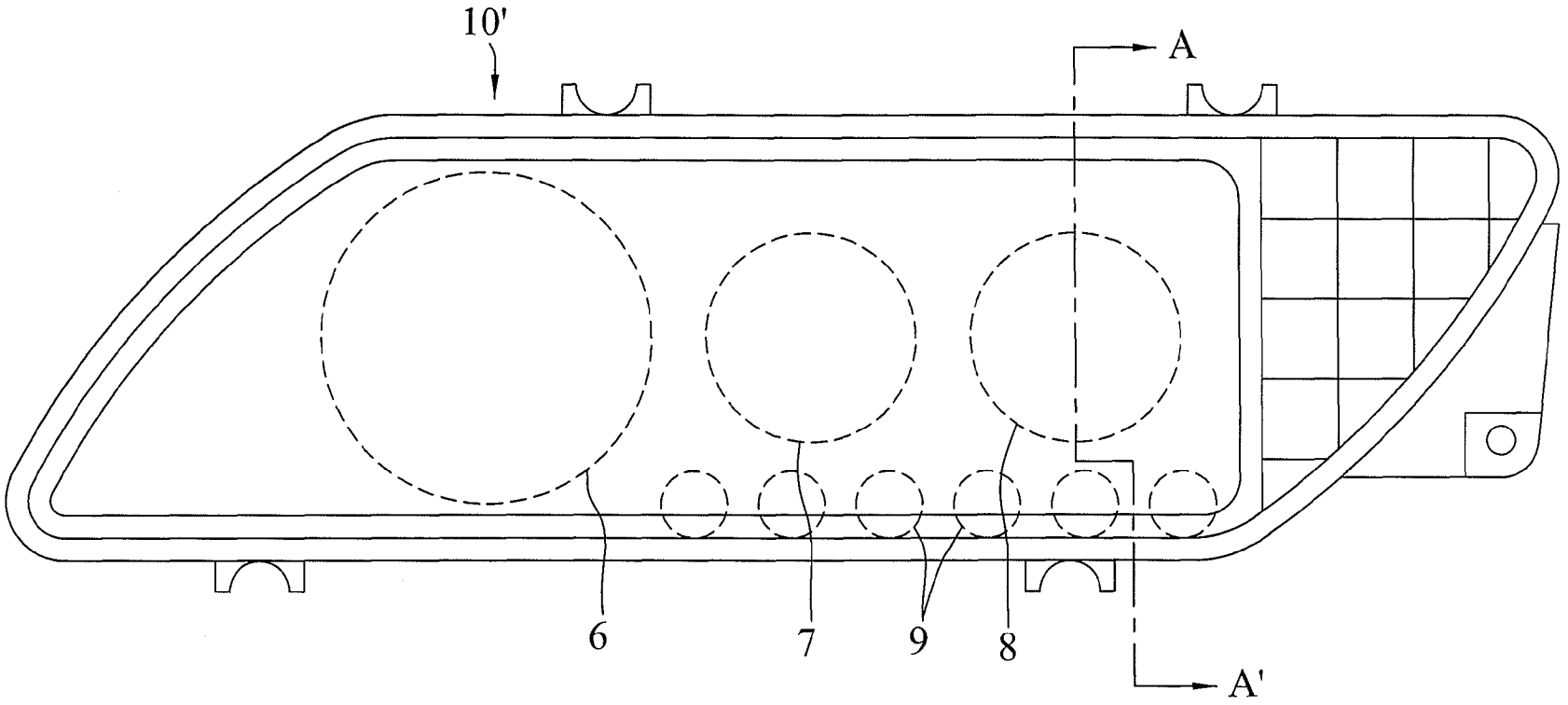
FIG. 18 is a cross-sectional side view of the thermal dispersing structure attached to a car headlamp combination.
Figures 1, 18:
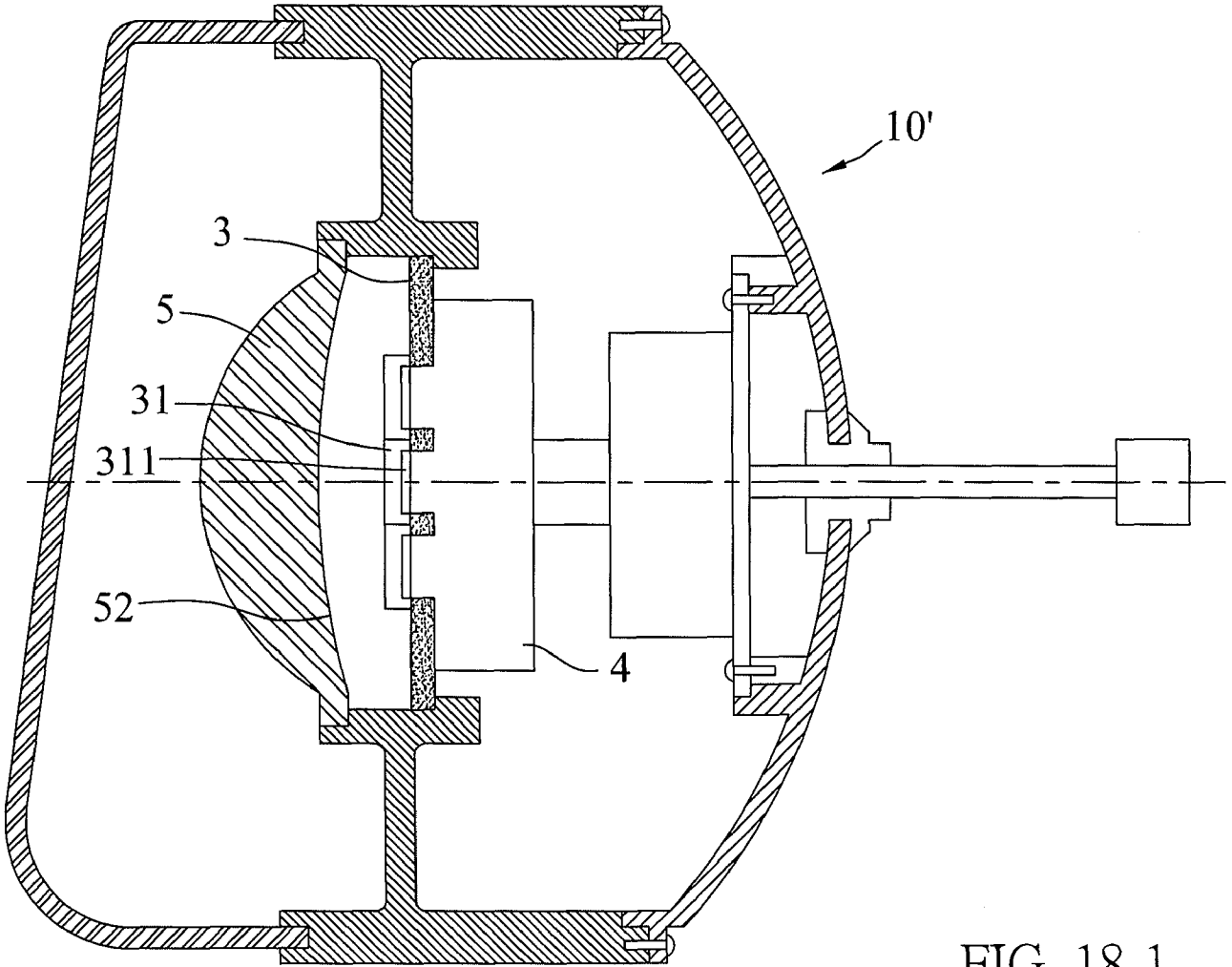

As shown in FIG. 17, the thermal dispersing structure for LED or SMD LED lights in the present invention constitutes a single bulb for car lamp 10. Additionally, as shown in FIGS. 18 and 18-1, the thermal dispersing structure constitutes a long-distance projecting lamp 6, auxiliary projecting lamp 7, fog lamp 8 or day-light signal lamp 9 on a combination of car head lamp 10'.

Figure 19:
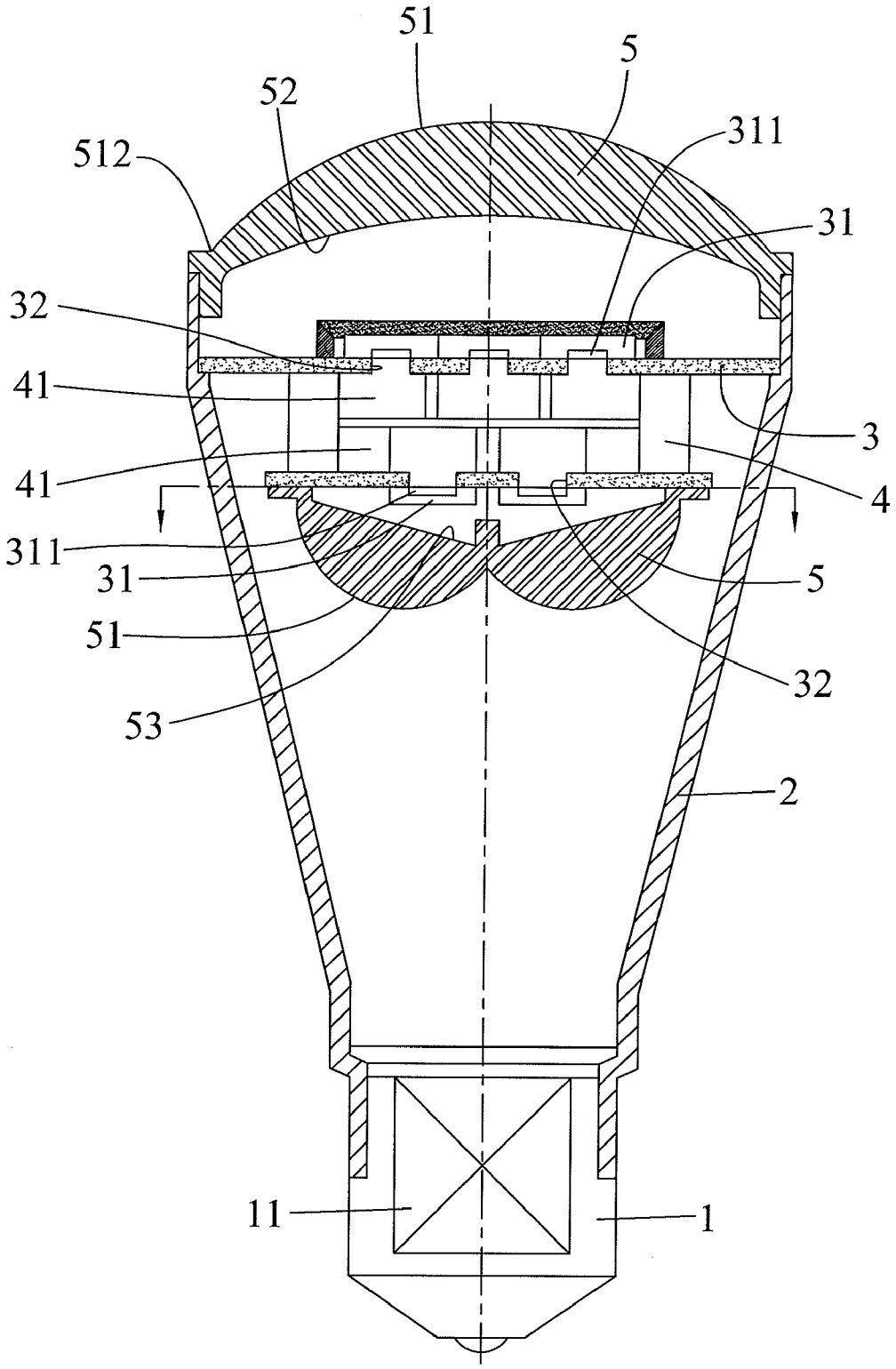
FIG. 19 is a cross-sectional side view of the thermal dispersing structure attached to a two-way projection light.
Figures 1, 19:
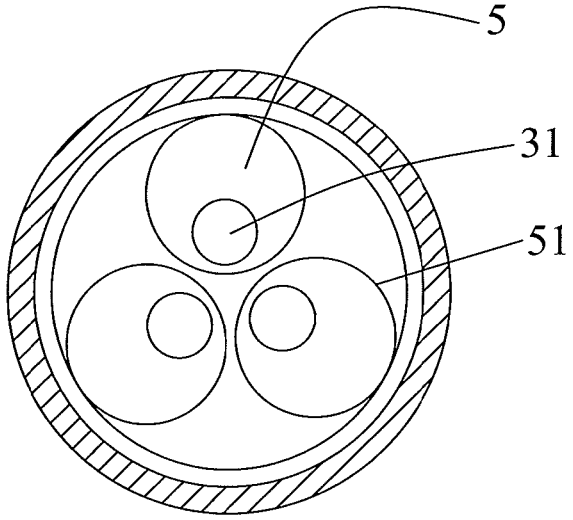

As shown in FIGS. 19 and 19-1, the thermal dispersing structure in this invention is applied to dual-way projecting lamp.

The thermal dispersing structure in this invention also enables to be applied to assembled LED lamps such as LED road lamp combination or decorative projecting LED lamps etc. (as shown in FIG. 20, 20-1 or 21-2).

According to above description, the thermal dispersing structure for LED or SMD LED lamps in this invention has the following advantages:

1. The thermal dispersing structure in this invention sufficiently conduct and disperse heat generated by the LED or SMD LED units 31 having high watts power to keep the LED or SMD LED units 31 working normally and to extend lifespan thereof.

2. By constructing the rim 33, one or multiple LED or SMD LED units 31 are sealed and collected therein to perform an approximate surface light source (as shown in FIG. 12).

3. The light-adjusting lens 5 with the inner planar surface or the inner concave surface processes the projecting light from the approximate surface light source to enlarge the light source to serve as secondary light-collecting. The foggy treatment of the inner planar surface and the inner concave surface enables to eliminate the dark difference outside the projecting light range of the light-adjusting lens, to achieve a surface light source, to have functions of high LUX, light uniformity, and to regulate projecting angle. Thereby, halation can be eliminated and light uniformity and light enhancement to maximum are achieved.

4. The sharp angle constituted by the outer convex arc and the planar connector is located at edge having the weakest projecting light but performs light-collecting ring to enhance the illumination. Moreover, the foggy treatment makes the light even and the performance of the sharp angle cooperates with the LUX at the projecting center to increase the light uniformity degree.

5. The distance D between the LED or SMD LED units 31 and the light-adjusting lens 5 is adjusted to regulate the projecting angle for the secondary stages and to enhance luminance and to improve light uniformity (as shown in FIGS. 14, 15, 16 and 16-1). Adjustment of the distance D instead of making different molds for lamps to achieve the same function is simple and easy to save cost in manufacture.

Although this invention has been described in its preferred form with a certain degree of particularity, it is understood that the present invention of the preferred form has been made only by way of example and that numerous changes in the details of construction and the combination and arrangement of parts any be resorted to without departing from the spirit and scope of the invention.

What is claimed is:

1. A thermal dispersing structure for LED or SMD LED lights comprising:

a lamp head;

a lamp base being a funnel shape mounted on the lamp head and having an enlarged top edge with an annular cutout defined near the enlarged top edge;

a substrate engaged the annular cutout and having at least one LED or SMD LED units each with at least one thermal conducting base and at least one hole defined on the substrate to receive the at least one thermal conducting base correspondingly; and a thermal dispersing body attached under the substrate and having at least one post penetrating a corresponding one of the at least one hole to engage a corresponding one of the at least one thermal conducting base.

2. The thermal dispersing structure as claimed in claim 1, wherein each of the at least one post has a height even or higher than a thickness of the substrate and has an outer diameter slightly smaller than an inner diameter of the corresponding one of the at least one hole of the substrate to snugly engage with the a corresponding one of the at least one of the thermal conducting base.

3. The thermal dispersing structure as claimed in claim 2, wherein the thermal dispersing body is coated with thermal conducting glue on periphery.

4. The thermal dispersing structure as claimed in claim 1, wherein the thermal dispersing body further has an engaging hole; and a cross-shaped thermal conducting post engaging a corresponding one of the at least one hole of the substrate and the engaging hole of the thermal dispersing body respectively.

5. The thermal dispersing structure as claimed in claim 4, wherein the thermal dispersing body, the thermal conducting post, or the post or the metal lamp base are made of thermal dispersing material such as aluminum, copper or nano-ferric ceramic in one-piece or in a sleeving piece.

6. The thermal dispersing structure as claimed in claim 1, wherein the thermal dispersing structure is constructed to serve a long-distance a projecting lamp, an auxiliary projecting lamp, a fog lamp, a day-light signal lamp, a combination of car head lamp, a dual-way projecting lamp, a LED road lamp combination or a decorative projecting LED lamp.

* * * * *